US008394257B2

(12) United States Patent
Etter

(10) Patent No.: US 8,394,257 B2
(45) Date of Patent: Mar. 12, 2013

(54) ADDITION OF A REACTOR PROCESS TO A COKING PROCESS

(76) Inventor: Roger G. Etter, Delaware, OH (US)

( * ) Notice: Subject to any disclaimer, the term of this patent is extended or adjusted under 35 U.S.C. 154(b) by 0 days.

(21) Appl. No.: 13/533,757

(22) Filed: Jun. 26, 2012

(65) Prior Publication Data

US 2012/0269685 A1 Oct. 25, 2012

Related U.S. Application Data

(63) Continuation of application No. 12/369,531, filed on Feb. 11, 2009, now Pat. No. 8,206,574, and a continuation-in-part of application No. 12/377,188, filed as application No. PCT/US2007/085111 on Nov. 19, 2007.

(60) Provisional application No. 61/027,577, filed on Feb. 11, 2008, provisional application No. 61/028,785, filed on Feb. 14, 2008, provisional application No. 60/866,345, filed on Nov. 17, 2006.

(51) Int. Cl.
*C10G 47/00* (2006.01)

(52) U.S. Cl. ..... 208/50; 208/52 R; 208/52 CT; 208/53; 208/54; 208/55; 208/131

(58) Field of Classification Search ..... 208/50, 208/52 R, 52 CT, 53–55, 67–77, 131, 208 R, 208/209–217, 250
See application file for complete search history.

(56) References Cited

U.S. PATENT DOCUMENTS

| | | | |
|---|---|---|---|
| 1,831,719 | A | 11/1931 | Pelzer |
| 1,873,024 | A | 8/1932 | Pelzer |
| RE20,011 | E | 6/1936 | Pelzer |
| 2,881,130 | A | 4/1959 | Pfeiffer et al. |
| 2,905,622 | A | 9/1959 | McCarthy |
| 2,922,755 | A | 1/1960 | Hackley, Jr. |
| 3,382,084 | A | 5/1968 | Folkins et al. |
| 3,617,480 | A | 11/1971 | Keel |
| 3,661,543 | A | 5/1972 | Saxton |
| 3,684,697 | A | 8/1972 | Gamson |
| 3,702,516 | A | 11/1972 | Luckenbach |
| 3,702,816 | A | 11/1972 | Buchmann et al. |
| 3,759,676 | A | 9/1973 | Lahn |
| 3,775,290 | A | 11/1973 | Peterson et al. |
| 3,775,294 | A | 11/1973 | Peterson et al. |
| 3,816,084 | A | 6/1974 | Moser, Jr. et al. |
| 3,842,165 | A | 10/1974 | Grindstaff et al. |
| 3,852,047 | A | 12/1974 | Schlinger et al. |
| 3,896,023 | A | 7/1975 | Ozaki et al. |
| 3,917,564 | A | 11/1975 | Meyers |
| 3,932,587 | A | 1/1976 | Grantham et al. |
| 3,960,701 | A | 6/1976 | Schroeder |
| 4,043,898 | A | 8/1977 | Kegler |
| 4,049,538 | A | 9/1977 | Hayashi et al. |
| 4,055,484 | A | 10/1977 | Blaser et al. |
| 4,096,097 | A | 6/1978 | Yan |
| 4,100,035 | A | 7/1978 | Smith |
| 4,178,229 | A | 12/1979 | McConaghy et al. |

(Continued)

FOREIGN PATENT DOCUMENTS

| | | |
|---|---|---|
| DE | 19540780 | 5/1996 |

OTHER PUBLICATIONS

W.R. Grace & Co.-Conn., Guide to Fluid Catalytic Cracking Part Two, copyright 1996, 98 pages.

(Continued)

*Primary Examiner* — Brian McCaig
(74) *Attorney, Agent, or Firm* — Standley Law Group LLP

(57) ABSTRACT

A reactor process added to a coking process to modify the quantity or yield of a coking process product and/or modify certain characteristics or properties of coking process products.

19 Claims, 6 Drawing Sheets

Figure 1:
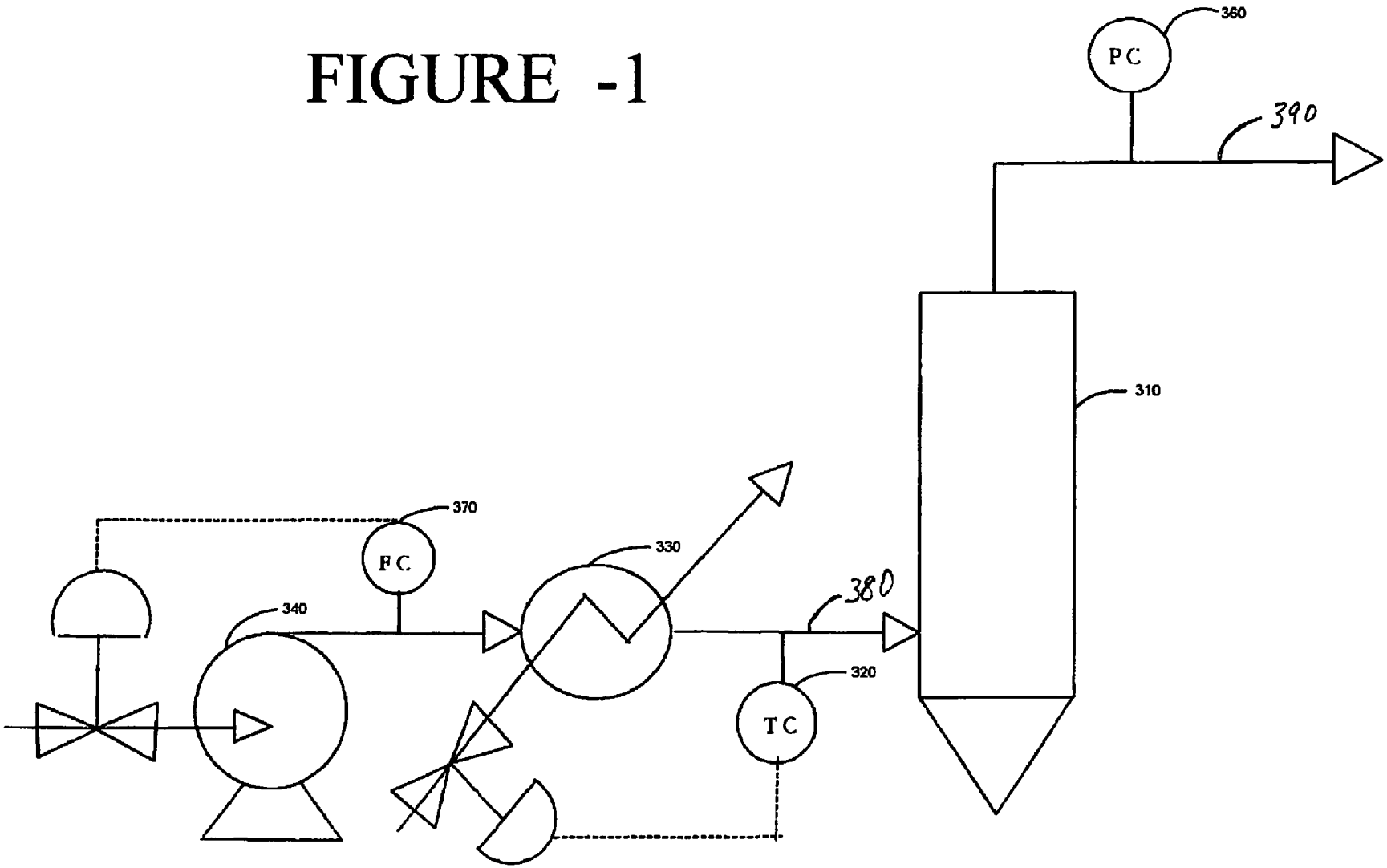

U.S. PATENT DOCUMENTS 4,188,277 A 2/1980 Martin
4,198,380 A 4/1980 Kohl
4,202,868 A 5/1980 Hayashi et al.
4,213,846 A * 7/1980 Sooter et al. ..... 208/50
4,269,696 A 5/1981 Metrailer
4,291,008 A 9/1981 Hsu et al.
4,295,956 A 10/1981 Metrailer
4,302,324 A 11/1981 Chen et al.
4,312,742 A 1/1982 Hayashi
4,326,853 A 4/1982 Sze et al.
4,334,980 A 6/1982 Hsu
4,364,741 A 12/1982 Villa
4,369,171 A 1/1983 Grindstaff et al.
4,388,152 A 6/1983 Wasson et al.
4,406,872 A 9/1983 Kapner et al.
4,441,887 A 4/1984 Funk
4,443,415 A 4/1984 Queneau et al.
4,447,259 A 5/1984 Ohyama et al.
4,455,219 A 6/1984 Janssen et al.
4,478,602 A 10/1984 Kelley et al.
4,479,804 A 10/1984 Chen et al.
4,481,101 A 11/1984 Yan
4,490,171 A 12/1984 Suzuki et al.
4,498,976 A 2/1985 Degnan et al.
4,518,486 A 5/1985 Jansma
4,519,898 A 5/1985 Allan
4,521,277 A 6/1985 Calderon et al.
4,534,951 A 8/1985 Kortovich et al.
4,547,284 A 10/1985 Sze et al.
4,551,232 A 11/1985 Calderon et al.
4,631,025 A 12/1986 Casper et al.
4,666,585 A 5/1987 Figgins et al.
4,797,197 A 1/1989 Mallari
4,828,680 A 5/1989 Green et al.
4,853,106 A 8/1989 Grove et al.
4,874,505 A 10/1989 Bartilucci et al.
4,895,636 A 1/1990 Chen et al.
5,007,987 A 4/1991 Block et al.
5,009,767 A 4/1991 Bartilucci et al.
5,015,362 A 5/1991 Chin
5,034,030 A 7/1991 Miller et al.
5,110,448 A 5/1992 Adams et al.
5,114,564 A 5/1992 Goyal
5,114,566 A 5/1992 Naeger et al.
5,165,902 A 11/1992 Bortz et al.
5,174,891 A 12/1992 Becraft
5,215,557 A 6/1993 Johnson et al.
5,246,680 A 9/1993 Esa
5,258,115 A 11/1993 Heck et al.
5,259,864 A 11/1993 Greenwalt
5,277,795 A 1/1994 Thornhill et al.
5,339,755 A 8/1994 Smith
5,350,503 A 9/1994 Freymeyer et al.
5,439,658 A 8/1995 Johnson et al.
5,470,556 A 11/1995 Samish
5,490,918 A 2/1996 Meek
5,496,729 A 3/1996 Monticello
5,529,599 A 6/1996 Calderon
5,591,326 A 1/1997 Shih
5,635,149 A 6/1997 Klingspor et al.
5,651,948 A 7/1997 Myers et al.
5,954,949 A 9/1999 Ohsol et al.
6,024,863 A 2/2000 LeCours et al.
6,048,448 A * 4/2000 Nirell ..... 208/67
6,056,882 A 5/2000 Scalliet
6,168,709 B1 1/2001 Etter
6,251,307 B1 6/2001 Lecours et al.
7,037,408 B2 5/2006 Wilborn
7,438,786 B2 10/2008 Malsbury
2001/0006156 A1 7/2001 Pereira et al.
2002/0179493 A1 12/2002 Etter
2004/0173504 A1 9/2004 Klasnich
2006/0032788 A1 2/2006 Etter
2006/0060506 A1 3/2006 Siskin et al.
2009/0145810 A1 6/2009 Etter
2009/0152165 A1 6/2009 Etter
2010/0170827 A1 7/2010 Etter

OTHER PUBLICATIONS

Ellis, Paul J. and Paul A. Christopher, Tutorial: Delayed Coking Fundamentals, Great Lakes Carbon Corporation, Prepared for presentation at the AIChE 1998 Spring National Meeting Mar. 8-12, 1998, 20 pages.
Fletcher, Peter, Delayed Coking, Chem. Engineer, (Sep./Oct. 1983), 21-23.
Janssen et al., Improved Coking Design Can Up Liquid Yields, Oil & Gas J. (Jun. 25, 1984) 79-83.
Lieberman, Norman, Shot Coke: Its Origins and Prevention, Oil & Gas J. (Jul. 8, 1985) 45-46.
Lieberman, Norman, Good Operating Techniques Improve Coker Yield, Increase Gas-Oil Production, Oil & Gas J. (Mar. 10, 1986) 53-54.
Lieberman, Norman, Procedure Reduces Coke Cutting Time for Large Drums, Gas & Oil J. (Nov. 24, 1986) 85-86.
Barnett, Jack, Desalters Can Remove More Than Salts and Sediment, Oil & Gas J. (Apr. 11, 1988) 43-49.
Archuletta et al., Cooperative Corrosion Control and Treatment Program Proves Effective, Gas & Oil J. (Aug. 6, 1990) 60-68.
Elliott, John, Design Operation Factors Can Up Coker Liquid Yields, Gas & Oil J. (Feb. 4, 1991) 41-44.
Filtration Method Efficiently Desalts Crude in Commercial Test, Gas & Oil J. (May 17, 1993) 59-60.
Bansal et al., Improve Your Coking Process, Hydrocarbon Processing (Feb. 1994) 63-66.
Stefani, A., Debottleneck Delayed Cokers for Greater Profitability, Hydorcarbon Processing (Jun. 1996) 99-103.
Harris, J.R., Use Desalting for FCC Feedstocks, Hydrocarbon Processing (Aug. 1996) 63-68.
Dickenson, et al., Refiner Options for Converting and Utilizing Heavy Fuel Oil, Hydrocarbon Processing (Feb. 1997) 57-62.
Auxiliary Equipment, Corrosion Focus of Refining Meeting, Oil & Gas J. (Apr. 4, 1994).
Wagoner et al., Burning Profiles for Solid Fuels, Amer. Soc. Mech. Eng. (Aug. 7, 1967) 1-8.
Reid, William, Ash Chemistry and Its Effect in Broiler Furnaces, Elec. Power Res. Inst. (Dec. 2, 1980) 1-13.
Burning Petroleum Coke: Boiler/Complex FGD or Fluid-Bed Combustor?, (Jul 7, 1983).
Lieberman, Norman, Time for Coking Cycle Can Be Routinely Halved, Oil & Gas J. (Aug. 29, 1983) 39-44.
Delayed Coking, Hydrocarbon Processing (Sep. 1984) 113.
Kronenberger et al., Troubleshooting the Refinery Desalter Operation, Materials Performance (Jul. 1986) 9-17.
Muzio et al., Dry Sorbent Emission Control Technologies, JAPC Assoc. (May 1987) 642-654.
Deepwater Fires 100% Coke, Sells All FGD Gypsoum Product, Power (Oct. 1988).
Lieberman, Norman, Frequently Asked Questions on Coke Quality Answered, Oil & Gas J. (Mar. 27, 1989) 67-69.
Makansi, Jason, Clean Air Act Amendments: The Engineering Response, Power (Jun. 1991) 11-60.
Herzog et al., Feasibility, Modeling and Economics of Sequestering Power Plant CO2 Emissions in the Deep Ocean, Envior. Progress vol. 10 (Feb. 1991) 64-74.
Elliott, J.D., Maximize Distillate Liquid Products, Hydrocarbon Proc. (Jan. 1992) 75-80.
Sulfur Dioxide Control, Steam 40 (1992) Chapter 35.
Fuel Ash Effects on Boiler Design and Operation, Steam 40 (1992) Chapter 20(pp. 1-28).
Sources of Chemical Energy, Steam 40 (1992) Chapter 8.
Burners and Combustion Systems for Pulverized Coal, Steam 40 (1992) Chapter 13.
Kent, James, Handbook of Industrial Chemistry, Published by Van Norstrand Reinhold (1992).
Rittenhouse, R.C., Action Builds on the Road to CAA Compliance (Part II), Power Eng. (Jun. 1992) 43-50.
Batra et al, Desing Process Equipment for Corrosion Control, Chem. Eng. Prog. (May 1993) 68-76.
Livengood et al., FG Technologies for Combined Control of SO2 and NOX, Power Eng. (Jan. 1994) 38-42.

Torrens et al., Electric Utility Response to the Clean Air Act Amendments, Power Eng. (Jan. 1994) 43-47.
Coke Quality, Oil & Gas J. (May 2, 1994) 114-115.
Wolsky et al, CO2 Capture From the Flue Gas of Conventional Fossil-Fuel-Fired Power Plants, Envr. Progress vol. 13 (Aug. 1994) 214-219.
Chue et al., Comparison of Activated Carbon and Zeolite 13X for CO2 Recovery From Flue Gas by Pressure Swing Adsorption, Amer. Chem. Soc. (1995) 591-598.
Akai et al., Performance Evaluation of Fossil Power Plant With CO2 Recovery and Sequestering System, Energy Conyers. Mgmt. vol. 36 Nos. 6-9(1995) 801-804.
Coking/Catalytic Cracking/Catalytic Reforming, HydroCarbon Processing (Oct. 1996).
Refining 1996, HydroCarbon (Nov. 1996).
Sincero & G.A. Sincero, Environmental Engineering a Design Approach, Types of Control (625-633), 1995.
Bisio & A. Boots, Air Pollution Control Methods, The Wiley Encyclopedia Energy and the Environment (vol. 1), 85-91, 1996.
Kiely, Gerard, Environmental Engineering, (344-345) & (757-776), 1998.
Handbook of Petroleum Refining Processes, (7/16- 7/29), 2003.
Delayed Coking, Chapter 5 (52-64).
Kirk-Othmer Ency. of Chem. Tehc. 3rd Ed., vol. 17 (194-219), 1978.
Kirk-Othmer Ency. of Chem Tech., 4th Ed., vol. 18 (433-469), 2001.
Ency. of Chem. Processing and Design, vol. 10 (1-41), 1980.
U.S. Department of Energy, DOE Techline Fossil Energy, New Research Focuses on Reducing Energy Consumption, Improving Environmental Performance of Refinery Coking Process, 2 pages, (Apr. 22, 1999).

* cited by examiner

ADDITION OF A REACTOR PROCESS TO A COKING PROCESS

This application is a continuation of U.S. application Ser. No. 12/369,531, now U.S. Pat. No. 8,206,574, filed Feb. 11, 2009, which claims priority to U.S. Provisional Application No. 61/027,577, filed Feb. 11, 2008, and U.S. Provisional Application No. 61/028,785, filed Feb. 14, 2008, and which is also a continuation-in-part of U.S. application Ser. No. 12/377,188, filed Feb. 11, 2009, which claims priority to PCT Application No. PCT/US2007/085111, filed Nov. 19, 2007, which claims priority to U.S. Provisional Application No. 60/866,345, filed Nov. 17, 2006, each of which is hereby incorporated by reference in its entirety.

FIELD OF THE INVENTION

This invention relates generally to the field of thermal coking processes, and more specifically to modifications of petroleum refining thermal coking processes to improve the product yields and/or the characteristics of the products of the coking process. Exemplary embodiments of the invention also relate generally to the addition of a reactor process for the modification of the chemical reactions for certain process streams of a coking process to improve the quantities and/or qualities of coker products.

BACKGROUND: DESCRIPTION OF KNOWN ART

Thermal coking processes have been developed since the 1930s to help crude oil refineries process the "bottom of the barrel." In general, modern thermal coking processes employ high-severity, thermal decomposition (or "cracking") to maximize the conversion of very heavy, low-value residuum feeds to lower boiling hydrocarbon products of higher value. Feedstocks for these coking processes normally consist of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coking feedstocks include atmospheric distillation residuum, vacuum distillation residuum, catalytic cracker residual oils, hydrocracker residual oils, and residual oils from other refinery units.

There are three major types of modern coking processes currently used in crude oil refineries (and upgrading facilities) to convert the heavy crude oil fractions (or bitumen from shale oil or tar sands) into lighter hydrocarbons and petroleum coke: delayed coking, fluid coking, and flexicoking. These thermal coking processes are familiar to those skilled in the art. In all three of these coking processes, the petroleum coke is considered a by-product that is tolerated in the interest of more complete conversion of refinery residues to lighter hydrocarbon compounds, referred to as 'cracked liquids' throughout this discussion. These cracked liquids range from pentanes to complex hydrocarbons with boiling ranges typically between 350 and 950 degrees F. In all three of these coking processes, the 'cracked liquids' and other products move from the coking vessel to the fractionator in vapor form. The heavier cracked liquids (e.g. gas oils) are commonly used as feedstocks for further refinery processing (e.g. Fluid Catalytic Cracking Units or FCCUs) that transforms them into transportation fuel blend stocks.

Crude oil refineries have regularly increased the use of heavier crudes in their crude blends due to greater availability and lower costs. These heavier crudes have a greater proportion of the 'bottom of the barrel" components, increasing the need for coker capacity. Thus, the coker often becomes the bottleneck of the refinery that limits refinery throughput. Also, these heavier crudes often contain higher concentrations of large, aromatic structures (e.g. asphaltenes and resins) that contain greater concentrations of sulfur, nitrogen, and heavy metals, such as vanadium and nickel. As a result, the coking reactions (or mechanisms) are substantially different and tend to produce a denser, shot (vs. sponge) coke crystalline structure (or morphology) with higher concentrations of undesirable contaminants in the pet coke and coker gas oils. Consequently, these three coking processes have evolved through the years with many improvements in their respective technologies.

Many refineries have relied on technology improvements to alleviate the coker bottleneck. Some refineries have modified their vacuum crude towers to maximize the production of vacuum gas oil (e.g. <1050 degree F.) per barrel of crude to reduce the feed (e.g. vacuum reduced crude or VRC) to the coking process and alleviate coker capacity issues. However, this is not generally sufficient and improvements in coker process technologies are often more effective. In delayed coking, technology improvements have focused on reducing cycle times, recycle rates, and/or drum pressure with or without increases in heater outlet temperatures to reduce coke production and increase coker capacity. Similar technology improvements have occurred in the other coking processes, as well.

In addition, coker feedstocks are often modified to alleviate safety issues associated with shot coke production or 'hot spots' or steam 'blowouts' in cutting coke out of the coking vessel. In many cases, decanted slurry oil, heavy cycle oil, and/or light cycle oil from the FCCU are added to the coker feed to increase sponge coke morphology (i.e. reduce shot coke production). This increase in sponge coke is usually sufficient to alleviate the safety problems associated with shot coke (e.g. roll out of drum, plugged drain pipes, etc.). Also, the increase in sponge coke can provide sufficient porosity to allow better cooling efficiency of the quench to avoid 'hot spots' and steam 'blowouts' due to local areas of coke that are not cooled sufficiently before coke cutting. However, the addition of these materials to coker feed reduces coking process capacities.

Unfortunately, many of these technology improvements have substantially decreased the quality of the resulting pet coke. Most of the technology improvements and heavier, sour crudes tend to push the pet coke from porous 'sponge' coke to 'shot' coke (both are terms of the art) with higher concentrations of undesirable impurities: Sulfur, nitrogen, vanadium, nickel, and iron. In some refineries, the shift in coke quality can require a major change in coke markets (e.g. anode to fuel grade) and dramatically decrease coke value. In other refineries, the changes in technology and associated feed changes have decreased the quality of the fuel grade coke with lower volatile matter (VM), gross heating value (GHV), and Hardgrove Grindability Index (GHI). All of these factors have made the fuel grade coke less desirable in the United States, and much of this fuel grade coke is shipped overseas, even with a coal-fired utility boiler on adjacent property. In this manner, the coke value is further decreased.

More importantly, many of these coker technology improvements have substantially reduced the quality of the gas oils that are further processed in downstream catalytic cracking units. That is, the heaviest or highest boiling components of the coker gas oils (often referred to as the 'heavy tail' in the art) are greatly increased in many of these refineries (particularly with heavier, sour crudes). In turn, these increased 'heavy tail' components cause significant reductions in the efficiencies of downstream catalytic cracking units. In many cases, these 'heavy tail' components are primarily polycyclic aromatic hydrocarbons (or PAHs) that have a high propensity to coke and contain much of the remaining, undesirable contaminants of sulfur, nitrogen, and metals. In downstream catalytic cracking units (e.g. FCCUs), these undesirable contaminants of the 'heavy tail' components can significantly increase contaminants in downstream product pools, consume capacities of refinery ammonia recovery/sulfur plants, and increase emissions of sulfur oxides and nitrous oxides from the FCCU regenerator. In addition, these problematic 'heavy tail' components of coker gas oils can significantly deactivate cracking catalysts by increasing coke on catalyst, poisoning of catalysts, and/or blockage or occupation of active catalyst sites. Also, the increase in coke on catalyst can require a more severe regeneration, leading to suboptimal heat balance and catalyst regeneration. Furthermore, the higher severity catalyst regeneration often increases FCCU catalyst attrition, leading to higher catalyst make-up rates, and higher particulate emissions from the FCCU. As a result, not all coker gas oil is created equal. In the past, refinery profit maximization computer models (e.g. Linear Programming Models) in many refineries assumed the same value for gas oil, regardless of quality. This tended to maximize gas oil production in the cokers, even though it caused problems and decreased efficiencies in downstream catalytic cracking units. Some refineries are starting to put vectors in their models to properly devalue these gas oils that reduce the performance of downstream process units.

U.S. Pat. No. 4,394,250 describes a delayed coking process in which small amounts of cracking catalyst and hydrogen are added to the hydrocarbon feedstock before it is charged to the coking drum to increase distillate yield and reduce coke make. The catalyst settles out in the coke and does not affect the utility of the coke.

U.S. Pat. No. 4,358,366 describes a delayed coking process in which small amounts of hydrogen and a hydrogen transfer catalyst, a hydrogenation catalyst, and/or a hydrocracking catalyst are added to a coker feed consisting of shale oil material and a petroleum residuum to enhance yields of liquid product.

Disadvantages of Catalyst with Coker Feed: This known art adds catalyst to the coker feed, which has substantially different chemical and physical characteristics than the reactants of the exemplary embodiments of the present invention. The coker feed of the known art is typically comprised of very heavy aromatics (e.g. asphaltenes, resins, etc.) that have theoretical boiling points greater than 1000° F. As such, the primary reactants exposed to the catalysts of the known art are heavy aromatics with a much higher propensity to coke (vs. crack), particularly with the exposure to high vanadium and nickel content in the coker feed. Furthermore, mineral matter in the coker feed tends to act as a seeding agent that further promotes coking. Calcium, sodium, and iron compounds/particles in the coker feed have been known to increase coking, particularly in the coker feed heater.

From a physical perspective, the primary reactants of the known art are a very viscous liquid (some parts semi-solid) at the inlet to the coker feed heater. Throughout the heater and into the coke drums the feed becomes primarily hot liquid, solids (from feed minerals and coking), and vapors (from coker feed cracking). The temperature of the multi-phase material at the inlet to the drum is typically between 900° F. and 950° F.

In commercial applications of the known art (i.e. catalyst in the delayed coker feed), excessive coking problems have been noted.

UTILITY AND ADVANTAGES OF THE INVENTION

Accordingly, exemplary embodiments of the present invention can (1) improve a quantity of a coker product or the overall yield distributions of coker products, (2) improve a quality or a property of one or more of the coker products, (3) improve operation, maintenance, throughput capacity, efficiency, and/or processing alternatives of the coking process (4) improve the operation, maintenance, throughput capacity, efficiency, and/or processing alternatives for other refinery processing units, and/or (5) provide additional catalytic cracking capacity for a crude oil refinery or upgrading system.

An exemplary embodiment of the present invention can increase or decrease the yield of the various types of coking process products (e.g. cracked liquids, coke, and/or gases). This embodiment of the present invention can effectively use the catalytic additive (by design) to effect an increase or decrease in the various types of desired coking process products, including but not limited to, naphtha, light gas oil, heavy gas oil, liquid petroleum gases (e.g. propanes & butanes), fuel gas, and coke. The added reactor process may be designed to convert the chemical compounds in the coking process streams or products from the thermal cracking and thermal coking reactions of the traditional coking process into other types of chemical compounds or desired products. In this manner, the catalyst characteristics can be modified to perform the desired reactions. For example, the reactor process added to the coking process can convert chemical compounds in the coking process recycle stream (that would normally form coke in the coking process) into cracked liquids or gas products.

Another exemplary embodiment of the present invention can improve the quality of various products of the coking process. In this embodiment, various process streams of the coking process can be converted by the reactor process added to the coking process into cracked liquids and gas products. For example, the quality of gas oils may be effectively improved by the added process reactor of exemplary embodiments of the current invention by (1) cracking various gas oil or recycle components to increase lighter cracked liquids or gases and/or (2) catalytically coking them. Depending on the design and operation of the particular reactor process, this selective cracking and/or coking of certain gas oil components may lead to a reduction in coker recycle and/or improve the quality of the coker gas oils, which may improve operation and efficiency of downstream processing units, particularly cracking units. Furthermore, exemplary embodiments of the present invention may be indirectly used to significantly improve the quality of the petroleum coke. An exemplary embodiment of the present invention may be used to enhance the quality of the petroleum coke by selective catalytic cracking of any heavy aromatic components (e.g. asphaltenes and their derivatives) of the recycle process stream of the coking process. This embodiment of cracking certain recycle components may remove components of the recycle that may detrimentally impact the coke morphology. Conceivably, this may be done in a manner that indirectly improves the quality of the pet coke for anode, electrode, fuel, or specialty carbon markets. An exemplary embodiment can also increase sponge coke morphology to avoid safety issues associated with shot coke production and 'hot spots' and steam 'blowouts' during coke cutting. In many cases, this may be done by cracking or coking heavy aromatics (e.g. asphaltenes and their derivatives) in the recycle process stream that can otherwise fill and block cooling channels in the coke. Typically, this may be done without using valuable capacity to add slurry oil or other additives to the coker feed to achieve these objectives. Furthermore, an exemplary embodiment of the present invention can reduce shot coke in a manner that may improve coke quality sufficiently to allow sales in the anode coke market.

Other exemplary embodiments of the present invention can improve the operation, maintenance, throughput capacity, efficiency, and/or processing alternatives for the coking process. That is, a reactor process may be added to the coking process in a manner that changes the coking process in a positive manner that can improve operation and/or maintenance. For example, an added reactor process may reduce the chemical compounds from the recycle process stream that have a high propensity to coke in the coking process heater, vapor line to the fractionator, and other coking process components and reduce operational problems and maintenance issues. In another embodiment, a reactor process may be added to the coking process in a manner that achieves a reduction of pet coke, gas production, and/or coker recycle that can all help to increase the throughput capacity of the coking process. An added reactor process may also be effectively used to provide other means to debottleneck the coking process. An exemplary embodiment of the present invention may also provide a superior means to increase coking process capacity without sacrificing the quality and quantity of desirable coker products, such as coker gas oil quality. In many cases, the increase in coking capacity also leads to an increase in refinery throughput capacity in refineries where the coking process is the refinery bottleneck. Other exemplary embodiments of the present invention may increase the efficiency of the coking process. For example, an added reactor process may effectively increase valuable products without additional process severity, decrease required recycle and associated heater fuel per barrel of feed processed, and/or decrease vapor loading to the fractionator, which all increase coking process efficiency. Furthermore, additional exemplary embodiments of the present invention may be used to provide processing alternatives in the coking process, including but not limited to, changing (1) coking process feed quality, (2) gas oil quantity and/or quality, (3) coke quantity and/or quality, and/or (4) quantity and/or quality of gas production.

Other exemplary embodiments of the present invention improve the operation, maintenance, throughput capacity, efficiency, and/or processing alternatives for other refinery processing units. The reactor process added to the coking process may improve these by improving the quantity and/or quality of the coking process products that are further processed in downstream refinery processing units. For example, improving the quality of gas oils may increase the efficiency and improve the operation, maintenance, and throughput capacity of the downstream fluid catalytic cracking unit (FCCU), and/or provide the opportunity to process some of these gas oil components in a hydrocracking process. Decreasing the quantity of these gas oils can also provide the opportunity to decrease the process severity of the FCCU and/or provide processing alternatives for other types of FCCU feeds. An exemplary embodiment of the present invention may also allow crude slate flexibility for refineries that want to increase the proportion of heavy, sour crudes without sacrificing coke quality, particularly with refineries that currently produce anode grade coke.

Finally, other exemplary embodiments of the present invention may provide additional catalytic cracking capacity for a crude oil refinery (or upgrading systems for shale oil, tar sands, etc.) by achieving cracking of process streams in the coking process beyond the thermal cracking that normally occurs. In some cases, the additional cracking in the coking process may be sufficient to provide an economic alternative to adding downstream cracking capacity (e.g. fluid catalytic cracking unit or hydrocracker) and/or the addition of catalytic cracking feed pretreatment.

In summary, the present invention has many exemplary embodiments that may occur somewhat independently, depending on several factors, including the quality and quantity of the catalytic additive. In many cases, however, the exemplary embodiments will overlap and occur concurrently, but to different degrees. As such, an exemplary embodiment of the present invention provides the opportunity to develop reactor process(es) to address the specific needs of a particular refinery. That is, the reactor process(es) may be specifically designed to improve the yield distribution to the products that are most valuable to that refinery's process scheme and crude slate opportunities. This approach may simply involve cracking to produce greater yields of cracked liquids or may involve a more sophisticated reactor process to be selective in desired types of cracked liquids. Similarly, an additional reactor process could be added to produce more of the desired products at that particular facility (e.g. propylene for local plastics plant) or selectively convert particular types of chemical species in the process streams of the coking process or intermediate chemical species in the coking process from other chemical reactions. That is, 'intermediate chemical species' shall refer to chemical species, including coking process products, in the coking process caused by thermal cracking, thermal coking, and various other chemical reactions with the coking process stream components. In this approach, the process optimization model in each refinery could be used as an effective tool in determining what catalytic additives would be preferable and worth pursuing (e.g. cost effectiveness and return on investment). All of the exemplary embodiments of the present invention potentially improve the overall refinery profitability. Further objects and advantages of this invention will become apparent from consideration of the drawings and ensuing descriptions.

SUMMARY OF THE INVENTION

It has been discovered that a reactor process may be introduced into traditional coking processes to modify the quantity or yield of a coking process product and/or modify certain characteristics or properties of coking process products. By adding a reactor process to the coking process, the conditions to promote desired chemical reactions for certain process streams of a coking process may be set independently from the primary reaction vessels of a coking process. Thus, operating conditions of a separate reactor process may be set independently from the operating conditions of the coking process. Said operating conditions may include but should not be limited to temperature, pressure, space velocity, residence time, contact time or any combination thereof. In this manner, the optimal operating conditions for a desired chemical reaction may be achieved for one or more process streams (e.g. slipstreams or side-streams vs. entire coker feed) of a coking process to modify said process stream to increase the yield of desirable products or change a property of said process stream. For example, the recycle process stream of a coking process may be condensed and processed separately (vs. recycled) and promote chemical reactions that deal with the heavy aromatic character of this coker process stream in a more efficient manner versus sending this material back through the coking process one or more times. The change in the process stream of the coking process is dependent on (but not limited to) (1) the design (e.g. residence time) of the added reactor process, (2) the operating conditions (e.g. temperature and pressure) of the added reactor process and (3) the characteristics of the process stream(s) of the coking process. Said reactor process may be as simple as adding one or more reaction vessel(s) or may have greater complexity, and may or may not be within the coking process boundary limits. Said desired chemical reaction may or may not include catalysts, hydrogen, or any combination thereof.

The added reactor process may include one or more types of catalysts to promote the desired chemical reactions for the design operating conditions (e.g. residence time, temperature, and pressure). The design of the added reactor process may include riser cracking reactor, fluidized bed reactor, ebullated bed reactor, fixed bed reactor, bunker reactor, plug flow reactor, or other reactor processes. The physical form of the catalysts may include various shapes and sizes, including traditional oil refining, petrochemical, and chemical catalysts. The formulation of the catalysts may include but should not be limited to catalyst substrates composed of various porous natural or man-made materials, including (but should not be limited to) alumina, silica, zeolite, calcium compounds, iron compounds, activated carbon, crushed coke, coal, or any combinations thereof. These substrates can also be activated and/or impregnated with other chemical elements or compounds that enhance catalyst activity, selectivity, other catalyst properties, or combinations thereof. These chemical elements or compounds can include (but should not be limited to) nickel, iron, vanadium, iron sulfide, nickel sulfide, cobalt, calcium, magnesium, molybdenum, sodium, associated compounds, or combinations thereof. Finally, the catalyst(s) may be formulated to enhance any one or more types of chemical reactions, including but not limited to, cracking reactions, coking reactions, pyrolysis reactions, hydrogenation reactions, hydrogenolysis reactions, hydrolysis reactions, addition reactions, dehydrogenation reactions, condensation reactions, polymerization reactions, aromatization reactions, oligomerization reactions, isomerization reactions, or any combination thereof. Regardless of how the catalyst is introduced (e.g. fixed bed, fluidized bed, or catalyst additive package) many of the desired catalyst properties (e.g. chemical composition and formulation including porosity characteristics) are the same as described below in the discussion regarding a catalytic additive package. As such, the entire discussion is not repeated here.

Furthermore, it has also been discovered that a catalytic additive package may enhance the effectiveness of the added reactor process by adding said catalytic additive package to one or more points in the added reactor process, to one or more points in the coking process, or any combination thereof. That is, a catalytic additive may be added to a coking process to improve the quantity and/or quality of one or more coking process products (U.S. Patent Application No. 61/026,028). In a similar manner, a catalytic additive may be effectively used in the added reactor process, particularly when the coker process stream (e.g. heavy aromatic recycle stream) presents problems for traditional catalytic systems (e.g. fixed bed catalyst). Likewise, a catalytic additive may be used in the coking process and the same or different catalytic additive may be simultaneously used in the added reactor process. For example, a catalytic additive could be used in the coking process to increase liquid yields by catalytically cracking heavy aromatics that would otherwise form coke. However, this may cause more materials (e.g. 'heavy tail' components) with theoretical boiling points >950° F. in the heavy coker gas oil. A reactor process may be added to catalytically crack these materials in the heavy coker gas oil (or recycle) using another catalytic additive. In this manner, coke production may be reduced without decreasing heavy coker gas oil quality and/or increasing recycle. In this case, the change in the products of the coking process is dependent on (but not limited to) (1) the quality and quantity of the catalytic additive package(s), (2) the existing design and operating conditions of the particular coking process, (3) the types and degree of changes in the coking process operating conditions, (4) the coking process feed characteristics, (5) the design and operating conditions of the added reactor process, and (6) the characteristics of the heavy coker gas oil or recycle.

DRAWINGS

FIG. 1 shows an exemplary embodiment of the present invention in its simplest form. This basic process flow diagram shows a simple reaction vessel that has sufficient controls to maintain desired reaction conditions, including (but not limited to) temperature, pressure and residence time via the design size of the reaction vessel and the flow rate of the process stream of the coking process.

Figure 2:
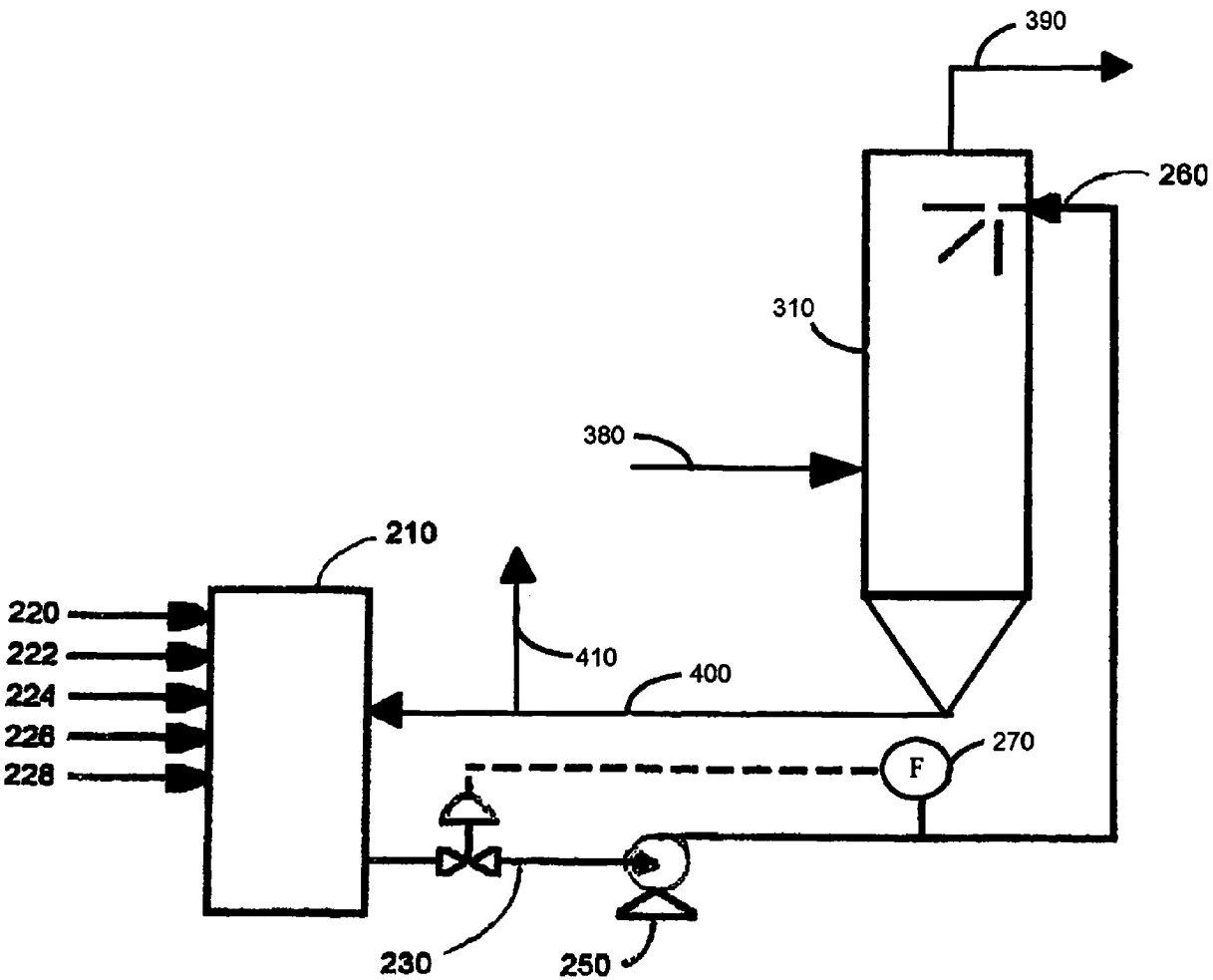

FIG. 2 shows an example of a catalytic additive system integrated with the added reactor process. As noted in the invention summary, this catalytic additive system can be used in the added reactor process, in the coking process, or both. This basic process flow diagram shows a heated, mixing tank where components of an exemplary embodiment of the present invention's additive can be blended: catalyst(s), seeding agent(s), excess reactant(s), carrier fluid(s), and/or quenching agent(s). The mixed additive is then added to a generic reactor process via a properly sized pump and piping, preferably with a properly sized atomizing injection nozzle.

Figure 3:
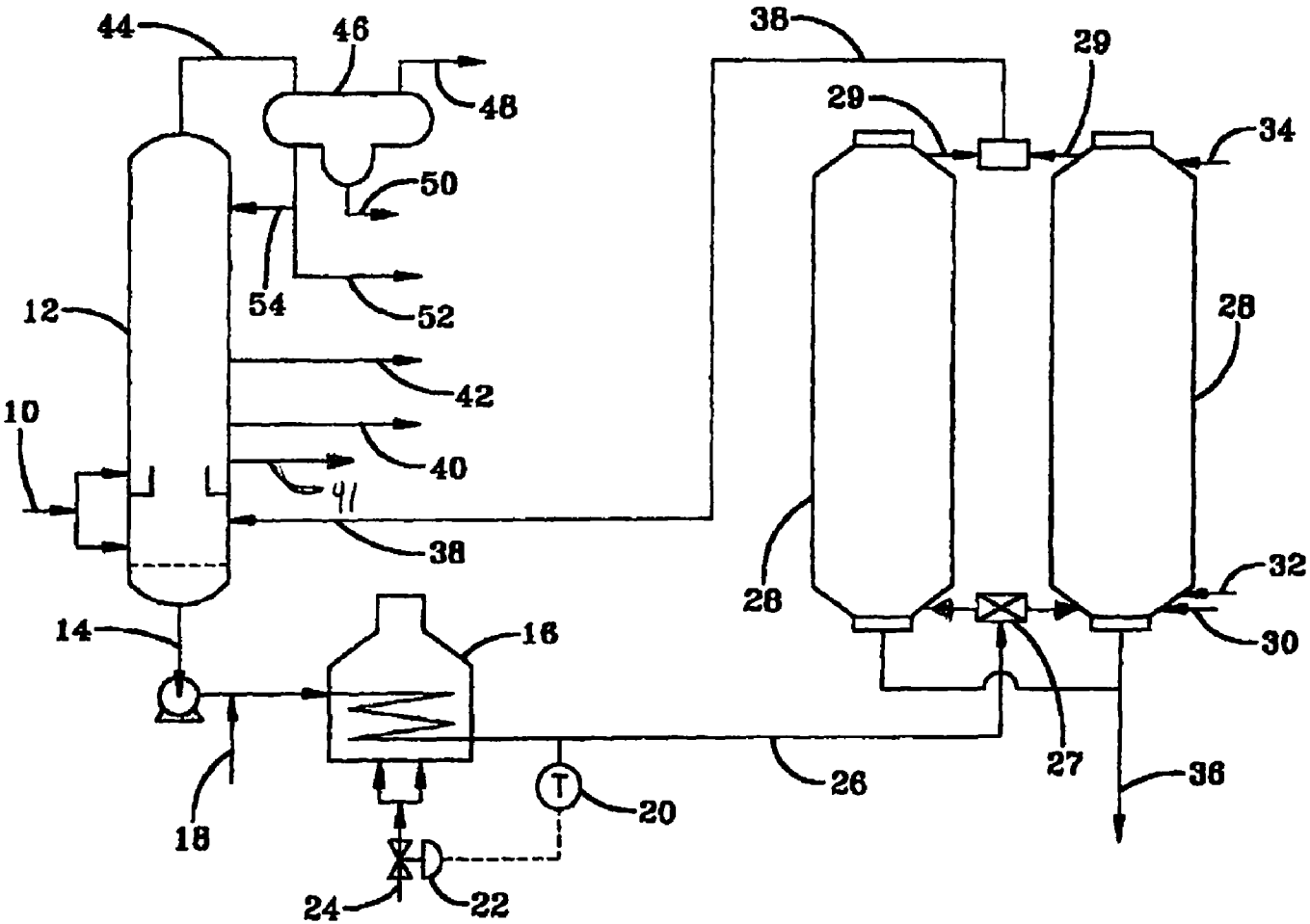

FIG. 3 shows a basic process flow diagram of the traditional, delayed coking technology of the known art.

Figure 4:
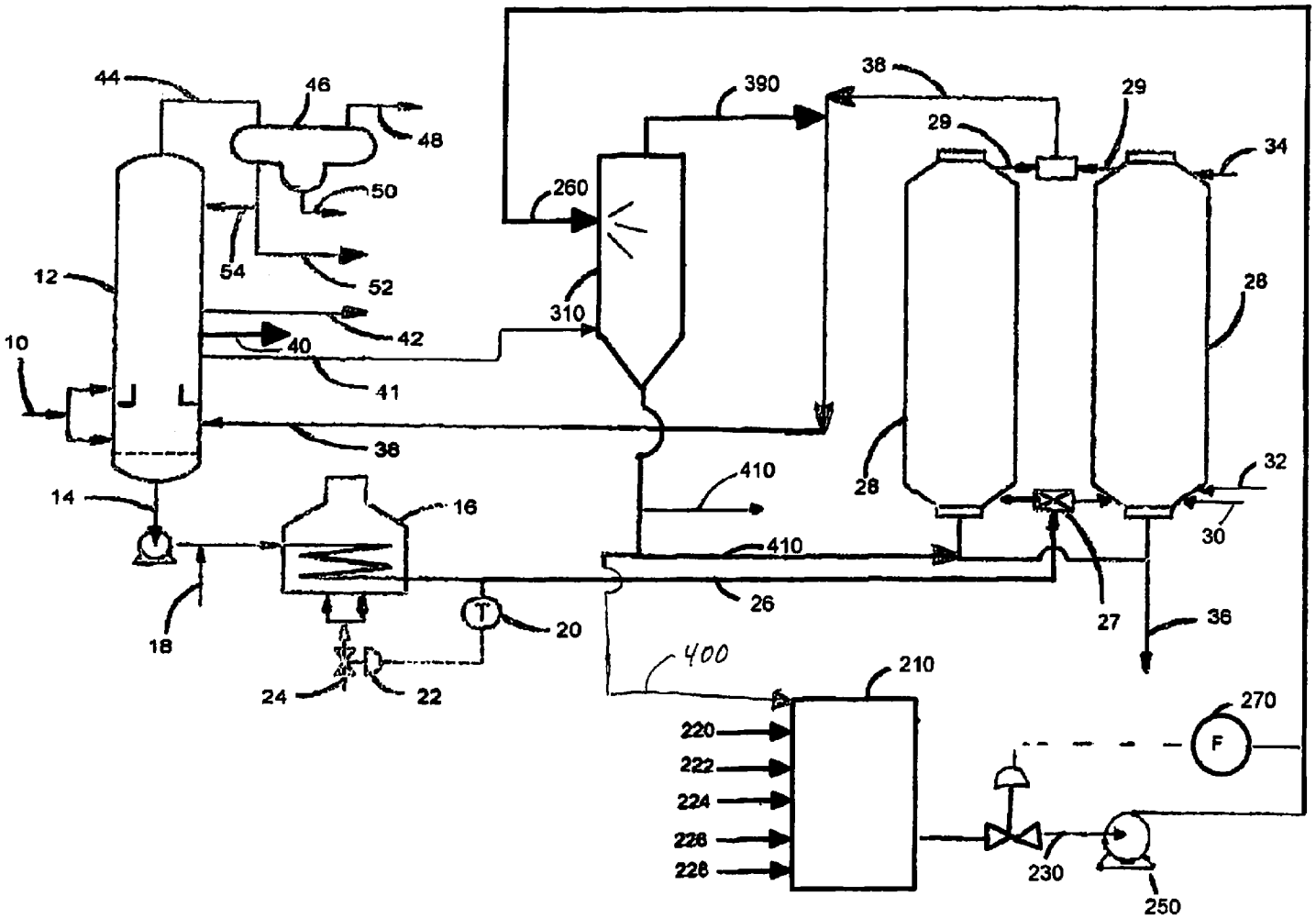

FIG. 4 shows an exemplary embodiment of the integration of a reactor process system of the present invention into the delayed coking process. The actual reactor process system may vary from refinery to refinery, particularly in retrofit applications. The reactor process may take one or more process streams and/or one or more partial process streams from the coking process to modify a quality and/or quantity of said process stream(s) or product. This Figure shows an example where the reactor process takes an extra heavy coker gas oil (XHCGO) from the coking process fractionator as a feed stream. This extra heavy coker gas oil is created by adding several additional trays and an additional side draw in the fractionation tower to separate out the heavier components of the traditional heavy coker gas oil. The extra heavy coker gas oil is comprised of most of the 'heavy tail' of the traditional, heavy coker gas oil as well as other gas oil components down to 750 degrees Fahrenheit boiling point. Also, this process stream (XHCGO) is taken directly from the fractionator (without cooling), is already at the desired temperature, and requires no further heating. In this example, a catalytic additive system has been added to the reactor process. The catalytic additive is injected into the reactor process through an injection nozzle on the side wall of the reaction vessel.

Figure 5:
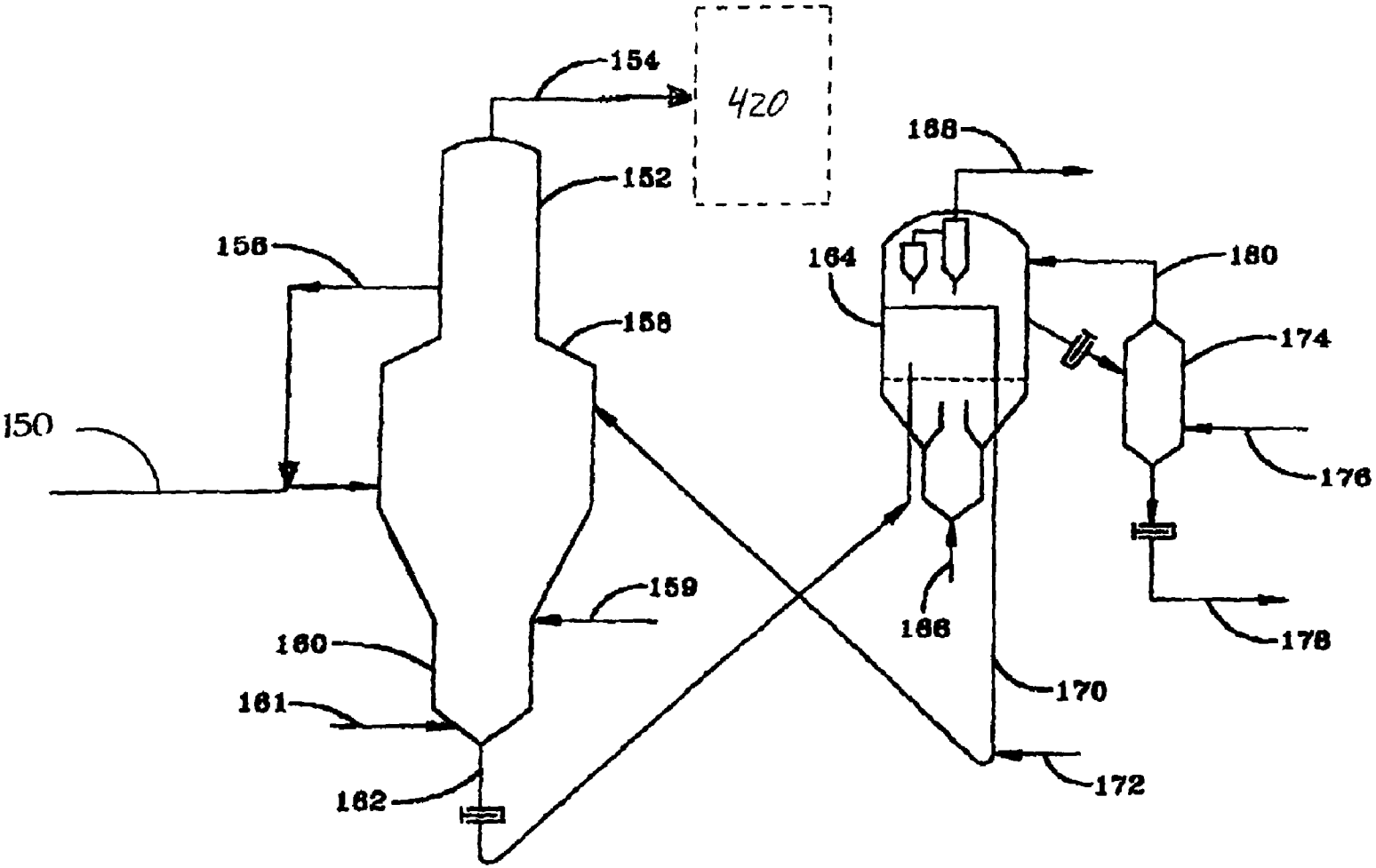

FIG. 5 shows a basic process flow diagram of the traditional, fluid coking technology of the known art. Flexicoking is essentially the same process with an additional gasifier vessel for the gasification of the by-product pet coke.

Figure 6:
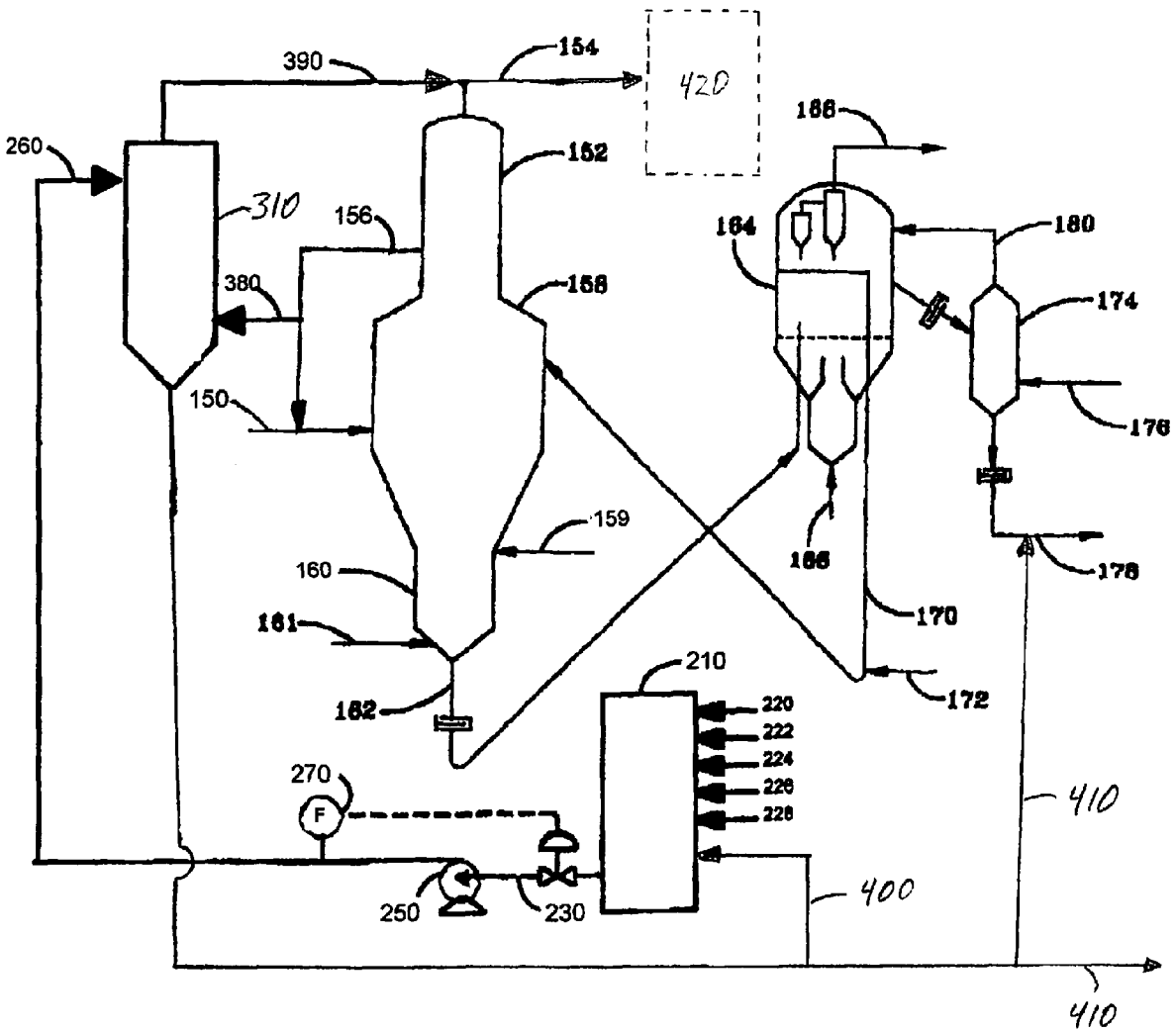

FIG. 6 shows an exemplary embodiment of the integration of a reactor process system of the present invention into the fluid coking and flexicoking processes. The actual reactor process system may vary from refinery to refinery, particularly in retrofit applications. The reactor process may take one or more process streams and/or one or more partial process streams from the coking process to modify a quality and/or quantity of said process stream(s) or product. This Figure shows an example where the reactor process takes the condensed recycle as a feed stream. In this example, wash oil is used to condense the recycle and becomes part of the feed stream to the added reactor process. Also, this process stream is already at the desired temperature, and requires no further heating. In this example, a catalytic additive system has been added to the reactor process. This exemplary embodiment shows the catalytic additive injected into the reactor process through an injection nozzle on the side wall of the reaction vessel.

DETAILED DESCRIPTION OF THE EXEMPLARY EMBODIMENT(S)

In view of the foregoing summary, the following presents a detailed description of the present invention and its exemplary embodiments, currently considered the best mode of practicing the present invention. The detailed description of the invention provides a discussion of the invention relative to the drawings. The detailed descriptions and discussion of the exemplary embodiments is divided into two major subjects: General Exemplary Embodiment and Other Embodiments. These embodiments discuss and demonstrate the ability to (1) alter the design and use of the added reactor process, (2) modify the quality or quantity of a catalytic additive package, and/or (3) change the operating conditions of the added reactor process to optimize the use of an exemplary embodiment of the present invention to achieve the best results in various applications.

Description and Operation of the Invention

General Exemplary Embodiment

Description of Drawings: FIG. 1 provides a visual description of the reactor process of an exemplary embodiment of the present invention in its simplest form. This basic process flow diagram shows a simple reaction vessel (310) that has sufficient controls to maintain desired reaction conditions, including (but not limited to) temperature, pressure, and residence time. The temperature is controlled by a feedback temperature controller (TC) (320) that controls the heat input of the process heater (330). The heater (330) may be (1) a new separate process heater, (2) a separate coil in the existing coking process heater (e.g. with modifications), and/or (3) other heat exchange equipment. This example of the added reactor process uses the outlet pressure of the feed pump (340) and backpressure controller (360) to control the pressure of the reaction vessel (310). The residence time in the reaction vessel is controlled by the design (e.g. space velocity) of the primary reaction vessel (310) for the desired flow rate of the process stream of the coking process, and the flow rate of the process stream from the coking process. The flow rate of this reaction vessel (310) is controlled by the flow controller (FC) (370) that controls the flow of the feed pump (340). The reactor process feed (380) typically is pumped into the bottom of the reaction vessel (310) and the reaction products (390) exit the top of the reaction vessel (310).

The type of reactor process and the optimal design and operation will vary among refineries due to various factors. The optimal design and operation may be determined in pilot plant studies or commercial demonstrations of this invention. Once this is determined, one skilled in the art can design this system to reliably control the operating conditions and catalyst additive addition (if used) to achieve the desired chemical reactions. This may be done on a batch or a continuous basis. One skilled in the art can also develop operating procedures for the proper startup, shutdown and normal operation, and determine the facility equipment requirements in its commercial implementation (e.g. reliability, safety, etc.).

The operation of the equipment in FIG. 1 may be fairly straightforward, after the appropriate type and design of the reactor process has been determined. The temperature, pressure, and other key operating conditions are controlled to the desired levels in the design. The components of the feed are combined and feed rate controlled to achieve the design residence time (e.g. space velocity) of the feed in contact with the catalyst in the catalyst additive or otherwise.

In the general exemplary embodiment, the added reactor process is designed to promote the desired reactions with the coker feed, intermediate chemical species, cracked liquids, vapor products, and/or other process streams in the coking process. This is primarily achieved by the choice of catalyst or catalyst additive package. The catalyst(s)' substrate and impregnated materials, activity, selectivity, and/or porosity characteristics will determine the types of reactants (e.g. gas oils) and products (e.g. Naphtha and fuel gas) from the catalytic reactions in the reactor process. For example, hydrocracking catalysts that are traditionally used for hydrocrackers may be very effective in an application to crack various aromatic molecules into lighter 'cracked liquids' at lower temperature, higher pressures, and higher hydrogen partial pressures than most hydrocracking or hydrotreating processes. Alternatively, residua cracking catalysts have a higher degree of mesoporosity and other characteristics that allow the large molecules of the high boiling point components to have better access to and from the catalyst's active cracking sites. In either case, the added reactor process and catalyst formulation can be designed to be more effective (e.g. selective cracking) and efficient for a particular type of chemical compound (e.g. heavy aromatics) in the coking process. As described previously, it is anticipated that various catalysts will be designed for the purposes above, particularly catalysts to achieve greater selective cracking of the coker feed, intermediate chemical species, cracked liquids, vapor products, and/or other coker process streams. This would include cracking of higher boiling point hydrocarbons to lower boiling point hydrocarbons that leave the coking vessel as vapors and enter the downstream fractionator where said lower boiling point hydrocarbons are separated into lower boiling point hydrocarbon process streams that are useful in oil refinery product blending. These lower boiling point hydrocarbon process streams include naphtha, gas oils, gasoline, kerosene, jet fuel, diesel fuel, heating oil, liquid petroleum gases, and fuel gas.

The type and formulation of any catalysts that may be used in the added reactor process will be determined by various technical and economic considerations. These considerations would include (but not be limited to) (1) the potential for plugging, fouling, poisoning, and other deterioration of the catalyst effectiveness, (2) the separation of the solids in the system and vapor/liquid products, and the size of the reaction vessel required for the desired residence time. In some cases, a catalyst additive system may be preferable to traditional catalyst systems (e.g. fixed bed).

FIG. 2 provides a visual description of the catalytic additive system of an exemplary embodiment of the present invention in its simplest form. As noted in the invention summary, this catalytic additive system may or may not be used in combination in the added reactor process: (1) in the added reactor process, (2) in the coking process, or (3) both. This basic process flow diagram shows a heated, mixing tank (210) where components of an exemplary embodiment of the present invention's additive can be blended: catalyst(s) (220), seeding agent(s) (222), excess reactant(s) (224), carrier fluid(s) (226), and/or quenching agent(s) (228). The mixed additive (230) is then injected into a generic reactor process (310) of an exemplary embodiment of the current invention via properly sized pump(s) (250) and piping, preferably with properly sized atomizing injection nozzle(s) (260). In this case, the pump is controlled by a flow meter (270) with a feedback control system relative to the specified set point for additive flow rate. The primary purpose of this process is to consistently achieve the desired additive mixture of components of an exemplary embodiment of the present invention and evenly distribute this additive to introduce said catalyst at the desired point or points in the reactor process. In general, the system should be designed to (1) handle the process requirements at the point(s) of injection and (2) prevent entrainment of the additive's heavier components (e.g. catalyst) into downstream equipment. As noted above, the reactor process feed (380) typically is pumped into the bottom of the primary reaction vessel (310) and the reaction products (390) exit the top of the primary reaction vessel (310). The solids (400) from the bottom of the reaction vessel (310) can be recirculated to the catalytic additive heated, mixing tank, if it has sufficient qualities. Otherwise, the solids (400) are further processed to recover and regenerate catalyst or dispose of it.

The specific design of the catalytic additive system and the optimal blend of additive components will vary among refineries due to various factors. The optimal blend may be determined in pilot plant studies or commercial demonstrations of this invention. Once this is determined, one skilled in the art can design this system to reliably control the quality and quantity of the additive components to provide a consistent blend of the desired mixture. This may be done on a batch or a continuous basis. One skilled in the art can also design and develop operating procedures for the proper piping, injection nozzles, and pumping system, based on various site specific factors, including (but not limited to) (1) the characteristics of the additive mixture (e.g. viscosity, slurry particle size, etc.), (2) the requirements of the additive injection (e.g. pressure, temperature, etc.) and (3) facility equipment requirements in their commercial implementation (e.g. reliability, safety, etc.).

Description of Additive: The additive of an exemplary embodiment of the present invention maybe a combination of components that have specific functions in achieving the utility of the respective exemplary embodiment. As such, the additive is not just a catalyst in all applications of the present invention, though it can be in many of them. In some applications (e.g. quenching vapor overcracking), there may be no catalyst at all in the additive. Thus, the term 'catalytic additive' does not apply in all embodiments, but could in many embodiments. The following discussion provides further breadth of the possible additive components, their utility, and potential combinations.

Said catalytic additive package consists of (1) catalyst(s), (2) seeding agent(s), (3) excess reactant(s), (4) quenching agent(s), (5) carrier fluid(s), or (6) any combination thereof. The optimal design of said catalytic additive package can vary considerably from refinery to refinery due to differences including, but not limited to, reactor process or coking process feed blend characteristics, process design & operating conditions, coker operating problems, refinery process scheme & processing objectives, downstream processing of the heavy coker gas oil, and/or the pet coke market & specifications.

Catalyst(s): In general, the catalyst consists of any chemical element(s) or chemical compound(s) that reduce the energy of activation for the desired reaction for coker feed, intermediate chemical species of the coking process, and/or other process streams. The catalyst may be designed to preferably favor certain cracking reactions and/or provide selectivity for the cracking of specific types of hydrocarbon reactants or products in the coking process (e.g. feed and/or vapor products). Similarly, the catalyst may be designed to preferably favor certain types of hydroprocessing, hydrocracking, hydrotreating, and/or isomerization reactions and/or provide selectivity for these reactions with specific types of hydrocarbon reactants in the coking process to produce certain types of products. Furthermore, the catalyst can be designed to preferably favor certain coking reactions and/or provide selectivity for the coking of specific types of hydrocarbon reactants or products, including specifications for coke morphology, quality & quantity of volatile combustible materials (VCMs), concentrations of contaminants (e.g. sulfur, nitrogen, and metals), or combinations thereof. Alternatively, the catalyst may be designed to selectively convert any heavy components (i.e. liquid, semi-liquid, or solid) of the coking process feed that tend to cause "hot spots" in the coke and 'blowouts' in decoking operations. In addition, the catalyst may be designed to preferentially coke via an exothermic, asphaltene polymerization reaction mechanism (vs. endothermic, free-radical coking mechanism). In this manner, the temperature of coke drum may increase, and potentially increase the level of thermal and/or catalytic cracking or coking. These various types of catalyst designs and/or others can be used separately or in any combination thereof. Finally, the catalyst may be formulated to enhance any one or more types of chemical reactions including but not limited to, cracking reactions, coking reactions, pyrolysis reactions, hydrogenation reactions, hydrogenolysis reactions, hydrolysis reactions, addition reactions, dehydrogenation reactions, condensation reactions, polymerization reactions, aromatization reactions, oligomerization reactions, isomerization reactions, or any combination thereof.

Physical and catalytic characteristics of this catalyst may be designed to perform the desired functions described throughout the description of the current invention. Typically, characteristics of this catalyst include a catalyst substrate and matrix with activation and treatments to perform the functions stated above. In many cases, the catalyst will have acid catalyst sites (e.g. Bronsted or Lewis) that initiate the propagation of positively charged organic species called carbocations (e.g. carbonium and carbenium ions), which participate as intermediates in the cracking, coking, and other reaction mechanisms. Since many of these reactions are initiated by the propagation of these carboncations, catalyst substrates that promote a large concentration of acid sites are generally preferred, but not required. For other types of desired catalytic reactions, catalyst substrates of a different nature may be preferred, including non-acid catalyst sites.

Also, the porosity characteristics of the catalyst would need to be designed for the desired reactions in the coking process. In general, the larger the molecular size of the reactants or products, the greater pore size required to mitigate diffusion resistance becoming a limiting factor in the reaction kinetics. For example, asphaltene molecules with molecular weights of 3000 to 48,000 can have molecular diameters of 50 to 300 Angstroms. Acceptable diffusion levels require at least 3 times the molecular diameter: 150 to 900 Angstroms, which is in the upper end of the mesopores range (i.e. 20 to 500 Angstroms) and the lower end of the macro pore range (i.e. >500 Angstroms). Thus, catalysts for these large molecules may preferably have a range of pore size distributions, including the need for a high matrix activity with a distribution of macropores with lower activity to control coke and gas make, and/or mesopores with higher activity. In contrast, traditional FCCU catalysts with an average diameter of 70 microns have substantial proportions of micropores with very high activity for predominantly parafinic feedstocks. With the larger proportion of mesopores and macropore characteristics, the catalyst would preferably allow the large, aromatic molecules easy access to the acid sites. In contrast, zeolites have very high acidic activity, but have pore size of approximately 9 angstroms, which are inaccessible to large hydrocarbon molecules. Thus, large hydrocarbon molecules are limited to cracking on the exterior of the zeolite and in the silica-alumina matrix. In addition, the greater the degree of mesoporosity and macroporosity of the catalyst, the longer residence time for reactions to occur at active sites in or near the vapor/liquid interface, in the liquid layer, and/or in coke layers of the delayed coking process. That is, the probability of continued catalytic reactions after becoming part of the liquid or coke layers is increased with greater catalyst porosity.

In addition, the catalyst is preferably sized between 20 and 600 microns, (preferably between 30 and 300 microns) small enough for catalyst fluidization and prevention of injector pluggage, but sufficiently large (e.g. >40 microns) to avoid entrainment in the vapors exiting the coking vessel (e.g. coke drum of the delayed coking process). For example, the catalyst and reactants (e.g. heavy aromatics) would preferably have sufficient density to settle to the vapor/liquid interface, liquid layer and/or coke layer of a delayed coking process. In this manner, the settling time to the vapor/liquid interface may provide valuable residence time in cracking the various feed components or cracked liquids vapor products (e.g. gas oils) of the coking process, prior to reaching the vapor/liquid interface. For certain heavy aromatics, equilibrium favors maximum aromatics cracking at low temperatures (e.g. 600 to 900 degrees Fahrenheit) preferably 700 to 850 degrees Fahrenheit with long residence times. Conceivably, the catalyst may continue promoting catalytic cracking reactions even after it becomes part of the porous coke. If the catalyst and the coke have sufficient porosity, the residence time for cracking potential hydrocarbon reactants (e.g. including a two phase feed flowing through the coke in a coke drum) can conceivably be up to the coker cycle time (e.g. 12 to 15 hours). In contrast, the effective residence time of catalytic reactions of the downstream cracking units (e.g. FCCU) is typically in seconds (e.g. <100 seconds). Potentially, this is why the heavy aromatics have a greater chance of cracking in the coking process with the catalytic additive of the present invention versus downstream catalytic cracking units (e.g. FCCUs).

Sizing the catalyst (e.g. 40 to >100 microns) to promote fluidization for the catalyst in the coking vessel may further enhance the residence time of the catalyst in the vapor zone. However, depending on the catalyst activity, this may not be desirable in many coking processes due to excessive gas production from cracking valuable cracked liquid products to gas. If the catalyst is sized for fluidization, cyclones similar to those in a fluid catalytic cracker (i.e. FCC) could be used in the coking vessel (e.g. coke drum) to control entrainment of catalyst particles in the gas vapors to the fractionation tower, and avoid catalyst particles and silica out of the product vapors and fractionator. Many types of catalysts can be used for the purposes of the present invention. Catalyst substrates can be composed of various porous natural or man-made materials, including (but should not be limited to) alumina, silica, zeolite, calcium compounds, iron compounds, activated carbon, crushed coke, coal, or any combinations thereof. These substrates can also be impregnated or activated with other chemical elements or compounds that enhance catalyst activity, selectivity, other catalyst properties, or combinations thereof. These chemical elements or compounds can include (but should not be limited to) nickel, iron, vanadium, iron sulfide, nickel sulfide, cobalt, calcium, magnesium, molybdenum, sodium, associated compounds, or combinations thereof. For selective cracking, many of the technology advances for selectively reducing coking may be used. For selective coking, the catalyst will likely include nickel, since nickel strongly enhances coking in the absence of significant hydrogen partial pressures. Furthermore, increased levels of porosity, particularly mesoporosity, can be beneficial in allowing better access by larger molecules to the active sites of the catalyst. Though the catalyst in the additive may improve cracking of the coking process feed components and cracked liquids/product vapors (e.g. gas oils) to lighter liquid products, the catalyst normally ends up in the coke. It is anticipated that various catalysts will be designed for the purposes above, particularly catalysts to achieve greater cracking of components of the feed, cracked liquids, and/or product vapors of the coking process to more valuable products. In these cases, the preferred catalyst formulation would initially crack feed components to maximize light products (e.g. cracked liquids), but ultimately promote the cracking or coking of other heavy aromatics to alleviate pitch materials (with a very high propensity to coke vs. crack) in the coke that cause 'hot spots.' However, with certain chemical characteristics of these materials and properly designed catalysts, substantial catalytic conversion of these materials to cracked liquids could be accomplished (e.g. >50 Wt. %).

The optimal catalyst or catalyst combinations for each application will often be determined by various factors, including (but not limited to) cost, catalyst activity and catalyst selectivity for desired reactions, catalyst size, and coke specifications (e.g. metals). In an exemplary embodiment, catalysts may be selected from a group consisting of new catalyst, FCCU equilibrium catalyst, spent catalyst, regenerated catalyst, pulverized catalyst, classified catalyst, impregnated catalyst, treated catalyst, or any combination thereof. For example, coke specifications for fuel grade coke typically have few restrictions on metals, but low cost can be the key issue. In these applications, spent or regenerated FCCU catalysts or spent, pulverized, and classified hydrocracker catalysts (sized to prevent entrainment) may be preferred. However, new, low cost catalysts designed for these purposes or new catalyst enhancers that can be mixed with spent or regenerated catalysts, may be most preferred. On the other hand, coke specifications for anode grade coke often have strict limits for sulfur and certain metals, such as iron, silicon, and vanadium. In these applications, cost is not as critical. Thus, new catalysts designed for high catalyst activity and/or selectivity may be preferred in these applications. Alumina or activated carbon (or crushed coke) impregnated with nickel may be most preferred for applications, where selective coking is desirable.

The amount of catalyst used will vary for each application, depending on various factors, including the catalyst's characteristics (e.g. activity, selectivity conversion, efficiency, and porosity), coke specifications and cost. In many applications, the quantity of catalyst will be less than 50 weight percent of the reactor process feed. Most preferably, the quantity of catalyst would be between 0.1 weight percent of the reactor process feed input to 7.0 weight percent of the reactor process feed input. Above these levels, the costs will tend to increase significantly, with diminishing benefits per weight of catalyst added. In some cases, the catalytic additive may not include a traditional catalyst at all, but still have desired effect(s) of the catalytic additive package. As described, the catalytic additive(s) may be added at various points in a coking process, including but not limited to an injection into the vapors exiting the coking vessel (e.g. above the vapor/liquid interface in the coke drum during the coking cycle of the delayed coking process) by various means, including pressurized injection with or without carrier fluid(s): hydrocarbon(s), oil(s), inorganic liquids, water, steam, nitrogen, or combinations thereof. Other injection points (i.e. said various points in a coking process) to add the catalytic additive may include (but not limited to) any point above the vapor/liquid interface of the coking vessel, a coking process feed, a coking process recycle, a coking process heater feed, a coking process heater outlet stream, a coking vessel inlet stream, a coking vessel vapor line, a coking process fractionator, or any combination thereof.

Addition of cracking catalyst alone in some coking process applications may be undesirable. That is, injection of a catalyst without excess reactant(s), quenching agent(s), and/or carrier oil, may actually increase undesirable reactions (e.g. vapor overcracking) and cause negative economic impacts.

Seeding Agent(s): In general, the seeding agent consists of any chemical element(s) or chemical compound(s) that enhances catalytic cracking or catalytic coking, particularly the formation of coke by providing a surface for the coking reactions and/or the development of coke crystalline structure (e.g. coke morphology) to take place. The seeding agent can be a liquid droplet, a semi-solid, solid particle, or a combination thereof. The seeding agent can be the catalyst itself or a separate entity. Sodium, calcium, iron, and carbon particles (e.g. crushed coke or activated carbon) are known seeding agents for coke development in refinery processes. These and other chemical elements or compounds can be included in the catalytic additive to enhance cracking or coke development from feed components or chemical intermediates in the coking process.

The amount of seeding agent(s) used will vary for each application, depending on various factors, including (but not limited to) the amount of catalyst, catalyst characteristics (e.g. activity, selectivity conversion, efficiency, and porosity), coke specifications, and cost. In many applications, catalytic cracking will be more desirable than catalytic coking. In these cases, seeding agents that enhance catalytic coking may be minimized, and the catalyst will be the only seeding agent. However, in some cases, little or no catalyst may be desirable in the additive. In such cases, the amount of seeding agent will be less than 15 weight percent of the reactor process feed. Most preferably, the quantity of seeding agent would be between 0.0 weight percent of the reactor process feed input to 3.0 weight percent of the reactor process feed input. In many cases, the amount of seeding agent is preferably less than 3.0 weight percent of the reactor process feed. As described, this seeding agent may be added to various points in the coking process by various means, including (but not limited to) pressurized injection with or without carrier fluid(s): hydrocarbon(s), oil(s), inorganic liquids, water, steam, nitrogen, or combinations thereof.

Excess Reactant(s): In general, the excess reactant consists of any chemical element(s) or chemical compound(s) that react with feed components, intermediate chemical species, and/or product vapors of the coking process to provide the desired reactions and reaction products. In the catalytic additive, the excess reactant may be a gas, a liquid, a semi-solid, solid particle or a combination thereof. Preferably, the excess reactants of choice are chemically reactive compounds.

Various types of excess reactants may be used for this purpose. Ideally, the excess reactant would contain very high concentrations of chemical elements or chemical compounds that react directly with a desired feed component, intermediate chemical species, cracked liquids, and/or vapor products of the coking process in the vapor phase, liquid phase, solid phase, or any combination thereof. Excess reactants would include, but should not be limited to, slurry oils, gas oils, extract from aromatic extraction units (e.g. phenol extraction unit in lube oil refineries), coker feed, bitumen, other aromatic oils, crushed coke, activated carbon, or combinations thereof. These excess reactants may be further processed (e.g. distillation) to increase the concentration of desired excess reactants components (e.g. aromatic compounds) and reduce the amount of excess reactant required and/or improve the reactivity, selectivity, or effectiveness of excess reactants with the targeted feed component(s), intermediate chemical species, cracked liquids, and/or product vapors of the coking process.

In some cases, the injection of hydrogen or other reactive gas, either with the catalytic additive or separately, may be desirable to enhance the catalyst's effectiveness. This is particularly true for situations where additional yields of cracked liquids would occur from mild hydrotreating, hydrocracking, hydroprocessing, or any combination thereof.

The amount of excess reactant used will vary for each application, depending on various factors, including (but not limited to) the amount of catalyst, catalyst characteristics (e.g. activity, selectivity conversion, efficiency, and porosity), coke specifications, and cost. In many applications, the quantity of excess reactant will be sufficient to provide more than enough moles of reactant to achieve the desired conversion of feed components, intermediate cemical species, cracked liquids, and/or vapor products in a coking process. Preferably, the molar ratio of excess reactant to targeted component(s) of the coking process would be in excess of that determined by one skilled in the art. However, in some cases, little or no excess reactant can be desirable in the additive. In many cases, the amount of excess reactant will be less than 50 weight percent of the reactor process feed. Most preferably, the quantity of excess reactant would be between 0.1 weight percent of the reactor process feed input to 7.0 weight percent of the coking process feed input. As described, this excess reactant may be added to various points in the coking process by various means, including (but not limited to) pressurized injection with or without carrier fluid(s): gas oils hydrocarbon(s), oil(s), inorganic liquids, water, steam, nitrogen, or combinations thereof.

Carrier Fluid(s): In general, a carrier fluid consists of any fluid that makes the catalytic additive easier to inject into the coking process. The carrier can be a liquid, gas, hydrocarbon vapor, or any combination thereof. In many cases, the carrier will be a fluid available at the coking process, such as gas oils or lighter liquid process streams, such as kerosene. In many cases, gas oil at the coking process is the preferable carrier fluid. However, carriers would include, but should not be limited to, FCCU slurry oils, decanted FCCU slurry oils, FCCU cycle oils, gas oils, other hydrocarbon(s), other oil(s), inorganic liquids, water, steam, nitrogen, hydrogen, or combinations thereof.

The amount of carrier fluid(s) used will vary for each application, depending on various factors, including (but not limited to) the amount of catalyst, catalyst characteristics (e.g. activity, selectivity conversion, efficiency, and porosity), coke specifications, and cost. In many applications, little or no carrier is actually required, but desirable to make it more practical or cost effective to add the catalyst additive into the coking process. The quantity of carrier fluid(s) will be sufficient to improve the ability to pressurize the additive for addition via pump or otherwise. In many cases, the amount of carrier will be less than 15 weight percent of the reactor process feed. Most preferably, the quantity of carrier fluid(s) would be between 0.1 weight percent of the reactor process feed input to 3.0 weight percent of the reactor process feed input. As described, this carrier fluid may help with addition of the catalytic additive into various points of the coking process by various means, including (but not limited to) pressurized injection.

Quenching Agent(s): In general, a quenching agent consists of any fluid that has a net effect of further reducing the temperature of various points in a coking process. The quenching agent(s) may be a liquid, gas, hydrocarbon vapor, or any combination thereof. Many refinery coking processes use a quench in the vapors downstream of the coking vessel (e.g. coke drum). In some cases, this quench can be moved forward into the coking vessel. In many cases, a commensurate reduction of the downstream quench may be desirable to maintain the same overall heat balance in the coking process. In many cases, gas oil available at the coking process will be the preferred quench. However, quenching agents would include, but should not be limited to, gas oils, FCCU slurry oils, FCCU cycle oils, other hydrocarbon(s), other oil(s), inorganic liquids, water, steam, nitrogen, or combinations thereof.

The amount of quench used will vary for each application, depending on various factors, including (but not limited to) the temperature of the coking process, the desired temperature of the coking process, and the quenching effect of the additive without quench, and/or characteristics and costs of available quench options. In many applications, the quantity of quench will be sufficient to finish quenching the vapors from the primary cracking and coking zone(s) in a coking vessel to the desired temperature. In some cases, little or no quench may be desirable in the additive. In many cases, the amount of quench will be less than 15 weight percent of the reactor process feed. Most preferably, the quantity of quench would be between 0.1 weight percent of the reactor process feed input to 7.0 weight percent of the reactor process feed input. As described, this quench may be added to various points in a coking process as part of the additive by various means, including (but not limited to) pressurized injection with or without carrier fluid(s): gas oils hydrocarbon(s), oil(s), inorganic liquids, water, steam, nitrogen, or combinations thereof.

Additive Combination and Injection: The catalytic additive components can be added to the coking process in combination or separately. In many applications, a blended additive would combine the 5 components to the degree determined to be desirable in each application. The catalytic additive components would be blended, preferably to a homogeneous consistency, and heated to the desired temperature (e.g. heated, mixing tank). For example, the desired temperature (e.g. >150 degrees F.) of the mixture may need to be increased to maintain a level of viscosity for proper pumping characteristics and fluid nozzle atomization characteristics. The additive, at the desired temperature and pressure, would then be pressurized (e.g. via pump) and added (e.g. via injection nozzle) to a coking process at the desired point. In many cases, insulated piping will be desirable to keep the additive at the desired temperature. Also, injection nozzles can be desirable in many cases to evenly distribute the additive across the cross sectional profile of the coking process (e.g. coking vessel). The injection nozzles would also be designed to provide the proper droplet size (e.g. 50 to 150 microns) to prevent entrainment of undesirable components into other components of the coking process. Typically, these injection nozzles would be aimed countercurrent to the flow of coking process. The injection velocity should be sufficient to penetrate the process flow and avoid undesirable entrainment into the coking process streams. However, the injection nozzles design and metallurgy must take into account the potential for plugging and erosion from the solids (e.g. catalyst) in the catalytic additive package, since the sizing of such solids must be sufficient to avoid entrainment into undesirable components of the coking process (e.g. product vapor stream). Other injection points (i.e. said various points in a coking process) to add the catalytic additive may include (but not limited to) any point above the vapor/liquid interface of the coking vessel, a coking process feed, a coking process recycle, a coking process heater feed, a coking process heater outlet stream, a coking vessel inlet stream, a coking vessel vapor line, a coking process fractionator, or any combination thereof.

The catalytic additive package of an exemplary embodiment of the current invention may also include anti-foam solution that is used by many refiners to avoid foamovers. These antifoam solutions are high density chemicals that typically contain siloxanes to help break up the foam at the vapor/liquid interface by its affect on the surface tension of the bubbles. In many cases, the additive package of the current invention may provide some of the same characteristics as the antifoam solution; significantly reducing the need for separate antifoam. In addition, the existing antifoam system may no longer be necessary in the long term, but may be modified for commercial trials and/or implementation of the current invention.

Said additive is believed to catalytically convert any feed components, intermediate chemical species, cracked liquids, or vapor products of the coking process by (1) providing a catalyst to reduce the activation energy of the desired chemical reactions, and/or (2) providing an excess reactant and appropriate reaction conditions to promote the desired chemical reactions in a vapor phase, liquid phase, solid phase, semi-solid phase, or any combination thereof. That is, said additive with a catalyst that has sufficient activity (e.g. active sites), sufficient selectivity, and sufficient porosity characteristics to reduce diffusion resistance may be used with or without excess reactant(s), quenching agent(s), seeding agent(s), carrier fluid(s), and/or anti-foam agent(s) to achieve the proper conditions for a desired chemical reaction(s) to produce a desired product(s). Said catalyst can be homogeneous or heterogeneous in nature and may react with a reactant(s) of the coking process in the gas phase, liquid phase, solid phase, or any combination thereof. In other words, (1) the reactants may diffuse to the catalysts' active sites, (2) the reactants react to form the desired products, byproducts, or any combination thereof, and (3) the products and/or byproducts diffuse from the catalyst's active sites. In many cases, the localized quench effect of the catalytic additive would cause the highest boiling point components (e.g. heavy aromatics) in the vapors to condense on the catalyst and/or seeding agent, and cause selective exposure of the said highest boiling point components to the catalysts' active sites. In this manner, selective cracking may occur in the liquid phase or in the gaseous phase, after these condensed materials revaporize as they settle to the vapor/liquid interface and reheat. After cracking the reactant(s), the cracked liquid products of lower boiling point will vaporize and/or then leave the catalyst active site. This vaporization causes another localized cooling effect that condenses the next highest boiling point component. Conceivably, this process may be repeated until the catalyst active site is blocked, poisoned, or otherwise made ineffective or the coking cycle ends. Equilibrium for some catalytic cracking (vs. coking) reactions (e.g. heavy aromatics) have been shown to favor lower temperatures (e.g. 700 to 800° F. vs. 850 to 925° F.), if given sufficient residence time and optimal catalyst porosity and activity levels. The additive settling time and the time at or below the vapor/liquid interface provide much longer residence times than encountered in other catalytic cracking units (e.g. FCCU). Thus, the ability to crack certain hydrocarbons is enhanced by this method of catalytic cracking. Ideally, the additive's active sites in many applications would repetitively crack hydrocarbons, prior to and after reaching the vapor/liquid interface, liquid layer, or coke layer, before cracking and/or coking additional hydrocarbon components and being integrated into the petroleum coke. This invention should not be limited by this theory of operation. However, both the injection of this type of said catalytic additive package and the selective cracking and coking of various feed components, intermediate chemical species, cracked liquids, and/or vapor products are contrary to conventional wisdom and current trends in the petroleum coking processes.

Enhancement of Additive Effectiveness: It has also been discovered that minor changes in coking process operating conditions may enhance the effectiveness of the catalytic additive package. The changes in coker operating conditions include, but should not be limited to, (1) reducing the coking vessel outlet temperature, (2) increasing the coking vessel outlet pressure, (3) reducing the coking feed heater outlet temperature, or (4) any combination thereof. The first two operational changes represent additional means to condense the highest boiling point materials in the product vapors to increase their residence time in the coking vessel. In many cases, the additive package is already lowering the temperature of the product vapors by its quenching effect and the intentional inclusion of a quenching agent in the additive package to increase this quenching effect. This quench effect reduces vapor overcracking reactions, as well as increases condensation of the highest boiling point materials in the product vapors. However, many coking units have a substantial quench of the product vapors in the vapor line between the coking vessel and the fractionator to prevent coking of these lines. In many cases, it may be desirable to move some of this quench upstream into the coking vessel. In some coking units, this can be accomplished by simply changing the direction of a quench spray nozzle (e.g. countercurrent versus co-current). As noted previously, a commensurate reduction in the downstream vapor quenching is often desirable to maintain the same overall heat balance in the coking process unit. If the coking unit is not pressure (compressor) limited, slightly increasing the coking vessel pressure can be preferable in many cases due to less vapor loading (caused by the quenching effect) to the fractionator and its associated problems. Finally, slight reductions of the feed heater outlet temperature may be desirable in some cases to optimize the use of the additive in the present invention. In some cases, reduction of the cracking of heavy aromatics and asphaltenes to the 'heavy tail' components of the coking process gas oils may reduce the amount of additive required to remove the 'heavy tail' and improve its effectiveness in changing coke morphology from shot coke to sponge coke crystalline structure. In some cases, other operational changes in the coking process can be desirable to improve the effectiveness of the present invention.

In the practical application of an exemplary embodiment of the present invention, the optimal combination of methods and embodiments will vary significantly. That is, site-specific, design and operational parameters of the particular coking process and refinery must be properly considered. These factors include (but should not be limited to) coker design, coker feedstocks, and effects of other refinery operations.

Description of Operation: The operation of the equipment in FIG. 1 is straightforward, after the appropriate additive mixture has been determined. The components are added to the heated (e.g. steam coils), mixing tank with their respective quality and quantity as determined in previous tests (e.g. commercial demonstration). Whether the mixing is a batch or a continuous basis, the injection of the additive of this invention is added to the coking process at the predetermined points and times to achieve the desired reactions while the coking process proceeds. For example, continuous injection may occur in the reactor during the coking cycle in the semi-continuous process of the delayed coking. However, in these cases, injection at the beginning and end of the coking cycles may not be preferable due to warm up and antifoam issues. Preferably, the flow rate of the additive of the present invention may be proportional to the flow rate of the coking process feed (e.g. 1.5 wt. %) and can be adjusted accordingly as the coking process feed flow rate changes.

In the general exemplary embodiment, the additive package is designed to promote the desired reactions with the coker feed, intermediate chemical species, cracked liquids, vapor products, and/or other process streams in the coking process. This is primarily achieved by the choice of catalyst. The catalyst(s)' substrate and impregnated materials, activity, selectivity, and/or porosity characteristics will determine the types of reactants (e.g. gas oils) and products (e.g. Naphtha and fuel gas) from the catalytic cracking in the coking process. For example, cracking catalysts that are traditionally used for cracking in fluid catalytic cracking units (e.g. Fluid Catalytic Cracking Unit or FCCU) can be very effective in an application to crack various hydrocarbon molecules into lighter 'cracked liquids'. Alternatively, residua cracking catalysts have a higher degree of mesoporosity and other characteristics that allow the large molecules of the high boiling point components to have better access to and from the catalyst's active cracking sites. In addition, the other components of the additive package may influence cracking reactions over coking reactions, as well. As described previously, it is anticipated that various catalysts will be designed for the purposes above, particularly catalysts to achieve greater selective cracking of the coker feed, intermediate chemical species, cracked liquids, vapor products, and/or other coker process streams. This would include cracking of higher boiling point hydrocarbons to lower boiling point hydrocarbons that leave the coking vessel as vapors and enter the downstream fractionator where said lower boiling point hydrocarbons are separated into lower boiling point hydrocarbon process streams that are useful in oil refinery product blending. These lower boiling point hydrocarbon process streams include naphtha, gas oils, gasoline, kerosene, jet fuel, diesel fuel, heating oil, liquid petroleum gases, and fuel gas.

In many cases, the achievement of additional selective cracking of the various coker process streams. to 'cracked liquids' products is worth the cost of fresh cracking catalyst versus spent or regenerated catalyst. This economic determination will depend on the chemical structures of the coker process streams.

In its preferred embodiment, this catalytic additive selectively cracks the heavier components of the coker feed or intermediate chemical species to produce additional cracked liquids, while reducing coke production, and/or quenching cracking reactions in the vapor to reduce gas production.

Description and Operation of Alternative Exemplary Embodiments

Delayed Coking Process

There are various ways the present invention may improve the delayed coking process. A detailed description of how the invention is integrated into the delayed coking process is followed by discussions of its operation in the delayed coking process and alternative exemplary embodiments relative to its use in this common type of coking process.

Traditional Delayed Coking Integrated with the Present Invention

FIG. 3 is a basic process flow diagram for the traditional delayed coking process of the known art. Delayed coking is a semi-continuous process with parallel coking drums that alternate between coking and decoking cycles. An exemplary embodiment of the present invention integrates one or more process reactor system(s) into the delayed coking process equipment. The operation with an exemplary embodiment of the present invention is similar, as discussed below, but significantly different.

In general, delayed coking is an endothermic reaction with the furnace supplying the necessary heat to complete the cracking and coking reactions in the coke drum. The exact mechanism of delayed coking is so complex that it is not possible to determine all the various chemical reactions that occur, but three distinct steps take place:

1. Partial vaporization and mild cracking of the feed as it passes through the furnace
2. Cracking of the vapor as it passes through the coke drum
3. Successive cracking and polymerization of the heavy liquid trapped in the drum until it is converted to vapor or coke.

In the coking cycle, coker feedstock is heated and transferred to the coke drum until full. Hot residua feed 10 (most often the vacuum tower bottoms) is introduced into the bottom of a coker fractionator 12, where it combines with condensed recycle. This mixture 14 is pumped through a coker heater 16, where the desired coking temperature (normally between 900.degree. F. and 950.degree. F.) is achieved, causing partial vaporization and mild cracking. Steam or boiler feed water 18 is often injected into the heater tubes to prevent the coking of feed in the furnace. Typically, the heater outlet temperature is controlled by a temperature gauge 20 that sends a signal to a control valve 22 to regulate the amount of fuel 24 to the heater. A vapor-liquid mixture 26 exits the heater, and a control valve 27 diverts it to a coking drum 28. Sufficient residence time is provided in the coking drum to allow thermal cracking and coking reactions to proceed to completion. By design, the coking reactions are "delayed" until the heater charge reaches the coke drums. In this manner, the vapor-liquid mixture is thermally cracked in the drum to produce lighter hydrocarbons, which vaporize and exit the coke drum. The drum vapor line temperature 29 (i.e. temperature of the vapors leaving the coke drum) is the measured parameter used to represent the average drum temperature. Petroleum coke and some residuals (e.g. cracked hydrocarbons) remain in the coke drum. When the coking drum is sufficiently full of coke, the coking cycle ends. The heater outlet charge is then switched from the first coke drum to a parallel coke drum to initiate its coking cycle. Meanwhile, the decoking cycle begins in the first coke drum. Lighter hydrocarbons 38 are vaporized, removed overhead from the coking drums, and transferred to a coker fractionator 12, where they are separated and recovered. Coker heavy gas oil (HGO) 40 and coker light gas oil (LGO) 42 are drawn off the fractionator at the desired boiling temperature ranges: HGO: roughly 650-970+.degree. F.; LGO: roughly 400-650.degree. F. In this example, several trays and another side draw in the coker fractionator provide an Extra Heavy Coker Gas Oil (41) (XH-CGO) cut that has a boiling temperature range of about 800 to 1050+ degrees Fahrenheit to remove the heaviest components (e.g. 'heavy tail') from the heavy coker gas oil. The fractionator overhead stream, coker wet gas 44, goes to a separator 46, where it is separated into dry gas 48, water 50, and unstable naphtha 52. A reflux fraction 54 is often returned to the fractionator.

In the decoking cycle, the contents of the coking drum are cooled down, remaining volatile hydrocarbons are removed, the coke is drilled from the drum, and the coking drum is prepared for the next coking cycle. Cooling the coke normally occurs in three distinct stages. In the first stage, the coke is cooled and stripped by steam or other stripping media 30 to economically maximize the removal of recoverable hydrocarbons entrained or otherwise remaining in the coke. In the second stage of cooling, water or other cooling media 32 is injected to reduce the drum temperature while avoiding thermal shock to the coke drum. Vaporized water from this cooling media further promotes the removal of additional vaporizable hydrocarbons. In the final cooling stage, the drum is quenched by water or other quenching media 34 to rapidly lower the drum temperatures to conditions favorable for safe coke removal. After the quenching is complete, the bottom and top heads of the drum are removed. The petroleum coke 36 is then cut, typically by a hydraulic water jet, and removed from the drum. After coke removal, the drumheads are replaced, the drum is preheated, and otherwise readied for the next coking cycle.

An exemplary embodiment of the present invention may be readily integrated into the traditional, delayed coker system, both new and existing. As shown in FIG. 4, this process flow diagram shows the traditional delayed coking system of FIG. 3 with the addition of an example of the present invention in FIG. 1 and possibly FIG. 2. This simplified example shows the addition of simplified reactor process with the addition of the catalytic additive system. Thus, an exemplary embodiment of the current invention integrates into the coking process, a simple reaction vessel (310) that has sufficient controls to maintain desired reaction conditions, including (but not limited to) temperature, pressure and residence time. Note: Items 320 through 370 are not shown in FIG. 4 due to lack of space, but would be similar to those items in FIG. 1. The temperature is controlled by a feedback temperature controller (TC) (320) that controls the heat input of the process heater (330). The heater (330) may be (1) a new separate process heater, (2) a separate coil in the existing coking process heater (e.g. with modifications), and/or (3) other heat exchange equipment, including potential cooling capabilities. This example of the added reactor process uses the outlet pressure of the feed pump (340) and back pressure controller (360) to control the pressure of the reaction vessel (310). The residence time in the reaction vessel is controlled by the design (e.g. space velocity) of the reaction vessel (310) for the desired flow rate of the coking process stream, and the flow rate of the process stream from the coking process. The flow rate of this reaction vessel (310) is controlled by the flow controller (FC) (370) that controls the flow of the feed pump (340). In this example, all or part of the extra heavy coker gas oil (41) becomes the reactor process feed (380), which is pumped into the bottom of the primary reaction vessel (310) and the reaction products (390) exit the top of the primary reaction vessel (310) to become part of the vapor products stream (38) that goes to the fractionator (12). The solids (400) from the bottom of the reaction vessel (310) can be recirculated to the catalytic additive heated, mixing tank (210), if it has sufficient qualities. Otherwise, the solids (410) are further processed to recover and regenerate catalyst, sold as a by-product (potentially with the pet coke), or disposed.

As an additional option, the current invention contemplates the addition of the catalyst additive system of FIG. 2 to the added reactor process, the coking process, or both. As shown in FIG. 4, an exemplary embodiment of the current invention may add a heated, mixing tank (210) where components of the present invention's additive can be blended: catalyst(s) (220), seeding agent(s) (222), excess reactant(s) (224), carrier fluid(s) (226), and/or quenching agent(s) (228). The additive may also be catalyst only that is heated (e.g. 800 to 1200 degrees Fahrenheit) to add heat to the reactor system. The mixed additive (230) is then injected into the one or more points in the delayed coking process via properly sized pump(s) (250) and piping, preferably with properly sized injection nozzle(s) (260). In this case, the pump is controlled by a flow meter (270) with a feedback control system relative to the specified set point for additive flow rate. In FIG. 4, the catalytic additive is injected into the reaction vessel (310) of the added reactor process. This same catalytic additive or a different catalytic additive could also be added to other points in the added reactor process of the one or more points in the coking process. Said one or more points in the delayed coking process would include (but should not be limited to) a hot residua feed 10, the bottom of a coker fractionator 12, condensed recycle, feed/recycle mixture 14, a coker heater 16, a vapor-liquid mixture 26 which exits the heater, and any combination thereof. Also, the catalytic additive may be added to a coking vessel at or above where the feed enters said coking vessel. In addition, the catalytic additive may be injected into a coker feed line, a coker vapor line, a coker fractionator, a coker feed pump, a coker heater, or any combination thereof. Furthermore, the catalytic additive may be introduced before a coking cycle, during a coking cycle, after a coking cycle, or any combination thereof.

Process Control of Traditional Delayed Coking with the Present Invention

In traditional delayed coking, the optimal coker operating conditions have evolved through the years, based on much experience and a better understanding of the delayed coking process. Operating conditions have normally been set to maximize (or increase) the efficiency of feedstock conversion to cracked liquid products, including light and heavy coker gas oils. More recently, however, the cokers in some refineries have been changed to maximize (or increase) coker throughput.

In general, the target operating conditions in a traditional delayed coker depend on the composition of the coker feedstocks, other refinery operations, and coker design. Relative to other refinery processes, the delayed coker operating conditions are heavily dependent on the feedstock blends, which vary greatly among refineries (due to varying crude blends and processing schemes or scenarios). The desired coker products and their required specifications also depend greatly on other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular refinery's coker design. Appropriate operating conditions are determined for a particular feedstock blend and particular product specifications set by the downstream processing requirements. The series of pilot plant studies are typically designed to produce empirical data for operating conditions with variations in feedstock blends and liquid product specification requirements. Consequently, the coker designs and target operating conditions vary significantly among refineries.

In common operational modes, various operational variables are monitored and controlled to achieve the desired delayed coker operation. The primary independent variables are feed quality, heater outlet temperature, coke drum pressure, and fractionator hat temperature. The primary dependent variables are the recycle ratio, the coking cycle time and the drum vapor line temperature. The following target control ranges are normally maintained during the coking cycle for these primary operating conditions:

1. Heater outlet temperatures in range of about 900.degree. F. to about 950.degree. F.,
2. Coke drum pressure in the range of about 15 psig to 100 psig: typically 15-25 psig,
3. Hat Temperature: Temperature of vapors rising to gas oil drawoff tray in fractionator
4. Recycle Ratio in the range of 0-100%; typically 10-20%
5. Coking cycle time in the range of about 12 to 24 hours; typically 15-20 hours
6. Drum Vapor Line Temperature 50 to 100.degree. F. less than the heater outlet temperature: typically 830-900.degree. Fahrenheit.

These traditional operating variables have primarily been used to control the quality of the cracked liquids and various yields of products. Throughout this discussion, "cracked liquids" refers to hydrocarbon vapor products of the coking process that have 5 or more carbon atoms. They typically have boiling ranges between 97 and 870.degree. F., and are liquids at standard conditions. Most of these hydrocarbon products are valuable transportation fuel blending components or feedstocks for further refinery processing. Consequently, cracked liquids are normally the primary objective of the coking process.

Over the past ten years, some refineries have switched coker operating conditions to maximize (or increase) the coker throughput, instead of maximum efficiency of feedstock conversion to cracked liquids. Due to processing heavier crude blends, refineries often reach a limit in coking throughput that limits (or bottlenecks) the refinery throughput. In order to eliminate this bottleneck, refiners often change the coker operating conditions to maximize (or increase) coker throughput in one of three ways:

1. If coker is fractionator (or vapor) limited, increase drum pressure (e.g. 15 to 20 psig.)
2. If coker is drum (or coke make) limited, reduce coking cycle time (e.g. 16 to 12 hours)
3. If coker is heater (or feed) limited, reduce coker recycle (e.g. 15 wt. % to 12 wt. %)

All three of these operational changes increase the coker throughput. Though the first two types of higher throughput operation reduce the efficiency of feedstock conversion to cracked liquids (i.e. per barrel of feed basis), they can maximize (or increase) the overall quantity (i.e. barrels) of cracked liquids produced. These operational changes also tend to increase coke yield and coke VCM. However, any increase in drum pressure or decrease in coker cycle time is usually accompanied by a commensurate increase in heater outlet and drum vapor line temperatures to offset (or limit) any increases in coke yield or VCM. In contrast, the reduction in recycle is often accomplished by a reduction in coke drum pressure and an increase in the heavy gas oil end point (i.e. highest boiling point of gas oil). The gas oil end point is controlled by refluxing the trays between the gas oil drawoff and the feed tray in the fractionator with partially cooled gas oil. This operational mode increases the total liquids and maintains the efficiency of feedstock conversion to cracked liquids (i.e. per barrel of feed basis). However, the increase in liquids is primarily highest boiling point components (i.e. 'heavy tail') that are undesirable in downstream process units. In this manner, ones skilled in the art of delayed coking can adjust operation to essentially transfer these highest boiling point components to either the recycle (which reduces coker throughput) or the 'heavy tail' of the heavy gas oil (which decreases downstream cracking efficiency). An exemplary embodiment of the present invention provides the opportunity to (1) increase coker throughput (regardless of the coker section that is limiting), (2) increase liquid yields, (3) reduce coke yield, (4) reduce gas production, and/or (5) may substantially reduce highest boiling point components in either recycle, heavy gas oil, or both. In this manner, each application of the present invention may determine which process is preferable to reduce the undesirable, highest boiling point components.

Impact of Present Invention on Delayed Coking Process

There are various ways the present invention may improve existing or new delayed coking processes in crude oil refineries and upgrading systems (e.g. shale oil, tar sands, bitumen, etc) for synthetic crudes. These novel improvements include, but should not be limited to, (1) improving a quantity of a coker product or the overall yield distributions of coker products, (2) improving a quality or a property of one or more of the coker products, (3) improving operation, maintenance, throughput capacity, efficiency, and/or processing alternatives of the coking process, (4) improving the operation, maintenance, throughput capacity, efficiency, and/or processing alternatives for other refinery processing units (5) catalytic cracking or coking of heavy aromatics in a manner that promotes sponge coke morphology and reduces 'hotspots' in coke cutting, (6) quenching drum outlet gases that reduce 'vapor overcracking', (7) debottlenecking all major sections of the delayed coking process (i.e. heater, drum, & fractionator sections, via reducing coker recycle, coke production, and vapor loading of fractionator, and/or (8) provide incremental catalytic cracking capacity for a crude oil refinery or upgrading system. For example, the use of a separate reactor to process coker recycle can substantially increase coker throughput, debottlenecking the coker and the refinery in applications where the coker is the refinery capacity limit.

In all the examples for delayed coking processes, an exemplary embodiment of the present invention provides the opportunity to develop a reactor process to address the specific needs of the particular refinery. That is, the reactor process may be specifically designed to improve the qualities or yield distribution of the products that are most valuable to that refinery's process scheme and crude slate opportunities. This approach may simply involve catalytic cracking to produce greater yields of cracked liquids or may involve a more sophisticated reactor process to be selective in what types of process stream(s) in the coking process may be converted to more valuable products. Similarly, an additional reactor process could be added to produce more of the desired products at that particular facility (e.g. propylene for local plastics plant). In this approach, the process optimization model in each refinery could be used as an effective tool in determining what catalytic additives would be preferable and worth pursuing (e.g. cost effectiveness and return on investment).

In many of the delayed coking process applications of the present invention, an exemplary embodiment of the present invention may achieve one or more of the following: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, (9) reduced incidents of 'hotspots' in pet coke drum cutting, and/or (10) reduced catalyst make-up and emissions in downstream cracking units.

The following examples provide illustrative applications of the current invention to the delayed coking process. Unless an exemplary embodiment of the current invention uses the optional catalytic additive addition to the coking process, the design and operation of the added reactor process is less sensitive to the petroleum coke type and market specifications. As such, the examples below are characterized by the reactor process feed streams (i.e. process streams of the coking process).

Example 1

As shown in FIG. 4, an exemplary embodiment of the current invention can add a reactor process in the coking process at a point where part or all of an extra heavy coker gas oil cut can become the feed to the added reactor process. This exemplary embodiment could be advantageous in various refinery applications, including (but not limited to) (1) a coking process wherein additional trays in the coker fractionator allows the separation of the heaviest components of the heavy coker gas oil into 'extra heavy gas oil' (term in the art), (2) a coking process with excessive heavy gas oil endpoint (e.g. >1050 Degrees Fahrenheit), (3) a coking process wherein the heavy coker gas oil contains excessive heavy aromatics (e.g. Polycyclic Aromatic Hydrocarbons (PAHs), asphaltenes, and/or asphaltene derivatives), and/or (4) a coking process with excessive recycle (e.g. limiting coker & refinery throughput), wherein better utilization of the heavy coker gas oil would relieve this bottleneck. In many of these cases, a reactor process added to the coking process designed to crack or coke the heavy coker gas oil components may be very beneficial.

As noted in the invention summary and the general exemplary embodiment, an optional catalytic additive (i.e. vs. traditional catalyst alternatives) may be used in the reactor process added to the coking process. In addition, an optional catalytic additive can be added to the coking process, as described in U.S. Patent Application No. 61/026,028. In this exemplary embodiment, a catalytic additive is used in both the coking process and the reactor process added to the coking process. In this example, a catalyst additive is injected in the coking process (e.g. via coke drums) to crack coker feed materials that would otherwise form coke, and reduce the production of coke to produce more valuable cracked liquids. However, feed materials of the coking process that would otherwise form coke may not crack sufficiently and may tend to increase 'heavy tail' components of the heavy coker gas oil, thus increasing heavy gas oil end point. The increased gas oil end point can cause problems in downstream cracking units, unless coker recycle can be increased to crack or coke the heaviest gas oil components. In many cases, the delayed coker is coke drum limited, which allows additional recycle without limiting capacity. In other cases, the reactor process may be added to (1) avoid limiting coker throughput by increasing recycle in a heater limited coker or (2) suffer lower conversion in downstream cracking units. Alternatively, (in this case) several trays and an additional side draw can be added to the coker fractionator to produce an extra heavy coker gas oil (XHCGO) that has a boiling range of about 800 to 1050+ degrees Fahrenheit. This improves the heavy coker gas oil quality for downstream cracking units without requiring increased coker recycle, that may limit throughput.

In this exemplary embodiment, the reactor process of the current invention is added to a delayed coking process to maintain or improve coker gas oil quality (e.g. endpoint) and maintain or increase coker throughput by catalytically cracking part or all of the extra heavy gas oil cut, particularly heavy aromatic compounds (e.g. PAHs). As such, the reactor process is preferably added to the coking process at a point near the fractionator. Conceivably, this reactor process could be added outside the coker boundary limits (e.g. in another process unit area), but placement as close to the coking process avoids long runs of pumping this difficult material to a distant process unit.

In this exemplary embodiment, the design of the reactor process system employs a catalytic additive and focuses on cracking of the extra heavy coker gas oil materials, particularly high boiling point materials (>950 degrees Fahrenheit) with a high propensity to coke (e.g. high Conradson Carbon Residue—CCR). Conversion of these highest boiling point components (e.g. heavy aromatics) to lighter liquid products would likely reduce gas oil endpoint and CCR sufficiently to use this extra heavy coker gas oil as feed to the downstream cracking units (e.g. FCCU). In some cases, a simplified reactor process using the proper catalytic additive of the current invention may be sufficient. As such, the physical design of this reactor process could include, but should not be limited to, (1) a low pressure, vertical reaction vessel, (2) injection of catalytic additive vertically downward at centerline of the reaction vessel, (3) feed added countercurrent (in some cases cocurrent) to the catalyst additive, (5) top draw of product vapors, and (6) bottom draw of solids in center of reaction vessel. The design and operating conditions of this reactor process should include, but should not be limited to (1) temperature of reaction vessel maintained at a temperature of 600 to 850 degrees Fahrenheit (preferably 700 to 800 degrees Fahrenheit), (2) pressure of reaction vessel maintained at 5.0 to 30 psig (preferably <20 psig), and (3) space velocity of 0.1 to 1.5. Higher levels of catalytic additive may be required in the reactor process, versus the quantity limitations of up to 15 weight percent of the feed of the coking process. The quantity of catalyst additive used in this exemplary embodiment would be between 0.1 weight percent and 50 weight percent; preferably between 0.1 weight percent and 10 weight percent. With this added reactor process primarily designed for catalytic cracking of the heaviest aromatics, feed materials with high aromatics content from other refinery processes or outside the refinery may be desirable, as well. These additional feed materials may include, but should not be limited to FCCU slurry oils, FCCU cycle oils, extract from aromatic extraction units, gas oils, bitumen, and other aromatic oils. It should be noted that this added reactor process can be readily designed to run fairly independently of the coking process, allowing separate shutdown and maintenance, if needed. Technical and economic optimization of the added reactor process can be performed by one skilled in the art to determine where this type of added reactor process may be feasible.

Example 2

In an exemplary embodiment of the current invention, a reactor process is added in the coking process at a point where part or all of condensed recycle becomes the feed to the added reactor process (Not shown in a Figure). This exemplary embodiment could be advantageous in various refinery applications, including (but not limited to) (1) a coking process with excessive recycle (e.g. limiting coker & refinery throughput), (2) a coking process with excessive heavy gas oil endpoint (e.g. >1050 Degrees Fahrenheit), (3) a coking process wherein the recycle contains excessive heavy aromatics (e.g. Polycyclic Aromatic Hydrocarbons (PAHs), asphaltenes, and/or asphaltene derivatives), and/or (4) a coking process wherein the recycle contains materials that are difficult to crack or coke and contribute to 'hot spots' in coke drums during the decoking cycle. In many of these cases, a reactor process added to the coking process designed to crack or coke these recycle materials may be very beneficial.

As noted in the invention summary and the general exemplary embodiment, an optional catalytic additive (i.e. vs. traditional catalyst alternatives) may be used in the reactor process added to the coking process. In addition, an optional catalytic additive can be added to the coking process, as described in U.S. Patent Application No. 61/026,028. In this exemplary embodiment, a catalytic additive is used in both the coking process and the reactor process added to the coking process. In this example, a catalyst additive is injected in the coking process (e.g. via coke drums) to crack coker feed materials that would otherwise form coke, and reduce the production of coke. As such, feed materials of the coking process that would otherwise form coke may tend to increase 'heavy tail' components of the heavy coker gas oil, thus increasing heavy gas oil end point, unless recycle is increased. In some of these cases, the reactor process may be added to (1) avoid limiting coker throughput by increasing recycle in a heater limited coker or (2) suffer lower conversion in downstream cracking units.

In this exemplary embodiment, the reactor process is added to a delayed coking process to maintain or improve coker gas oil quality (e.g. endpoint) and maintain or increase coker throughput by catalytically cracking condensed recycle materials, particularly heavy aromatic compounds (e.g. PAHs). As such, the reactor process is preferably added to the coking process at a point near the vapor lines from the coke drums to the fractionator or close to the base of the fractionator. Conceivably, this reactor process could be added outside the coker boundary limits (e.g. in another process unit area), but placement as close to the coking process avoids long runs of pumping this difficult material to a distant process unit. In this manner, the recycle could be condensed in the vapor line or in the base of the fractionator in a manner that separates this process stream (or intermediate stream) from the other vapors and products to be independently processed by the added reactor process. The addition of some lighter process stream (e.g. heavy coker gas oil) may be desirable to quench these recycle materials out of the vapor stream upstream of where the feed from the coking process condenses the recycle to be included in the coker feed. This lighter process stream may also be used to dilute the recycle to make it more pumpable, more readily processed, and other feed blend considerations. Part or all of the recycle may be treated as feed to the added reactor process.

In this exemplary embodiment, the design of the reactor process system employs a catalytic additive and focuses on cracking of the recycle materials, particularly heavy aromatics. Maximizing conversion of these heavy aromatics to lighter liquid products would likely require a simplified hydroprocessing process with high hydrogen partial pressure, low feed temperatures, and relatively long residence time. This theory of maximizing conversion of heavy aromatics is used in this exemplary embodiment, but should not limit the current invention. As such, the physical design of this reactor process could include, but should not be limited to, (1) a high pressure, vertical reaction vessel, (2) injection of catalytic additive vertically downward at centerline of the reaction vessel, (3) hydrogen injected in close proximity to catalytic additive, (4) feed added countercurrent (in some cases cocurrent) to the catalyst additive, (5) top (or side) draw of products, and (6) bottom draw of solids in center of reaction vessel. The design and operating conditions of this reactor process should include, but should not be limited to (1) temperature of reaction vessel maintained at a temperature of 600 to 850 degrees Fahrenheit (preferably 700 to 800 degrees Fahrenheit), (2) pressure of reaction vessel maintained at 1200 to 5000 psig (preferably >1500 psig), and (3) space velocity of 0.1 to 1.5. Higher levels of catalytic additive may be required in the reactor process, versus the quantity limitations of up to 15 weight percent of the feed of the reactor process. The quantity of catalyst additive used in this exemplary embodiment would be between 0.1 weight percent and 50 weight percent; preferably between 0.1 weight percent and 10 weight percent. With this added reactor process primarily designed for catalytic cracking of aromatics, feed materials with high aromatics content from other refinery processes or outside the refinery may be desirable, as well. These additional feed materials may include, but should not be limited to FCCU slurry oils, FCCU cycle oils, extract from aromatic extraction units, gas oils, bitumen, and other aromatic oils, It should be noted that this added reactor process can be readily designed to run fairly independently of the coking process, allowing separate shutdown and maintenance, if needed. Technical and economic optimization of the added reactor process can be performed by one skilled in the art to determine where this type of added reactor process may be feasible.

Fluid Coking and Flexicoking Processes

An exemplary embodiment of the present invention may also provide significant improvements in other coking technologies, including the fluid coking and flexicoking processes. The flexicoking process is essentially the fluid coking process with the addition of a gasifier vessel for gasification of the petroleum coke. A detailed description of how an exemplary embodiment of the present invention is integrated into the fluid coking and flexicoking processes is followed by discussions of its operation in the fluid coking and flexicoking processes and alternative exemplary embodiments relative to its use in these types of coking processes.

Traditional Fluid Coking and Flexicoking Integrated with the Present Invention FIG. 5 shows a basic process flow diagram for a traditional, fluid coking process. The flexicoking process equipment is essentially the same, but has an additional vessel for the gasification of the product coke 178 (remaining 75 to 85% of the coke that is not burned in the Burner 164). Fluid coking is a continuous coking process that uses fluidized solids to further increase the conversion of coking feedstocks to cracked liquids, and reduce the volatile content of the product coke. Fluid coking uses two major vessels, a reactor 158 and a burner 164.

In the reactor vessel 158, the coking feedstock blend 150 is typically preheated to about 600 to 700 degree F., combined with the recycle 156 from the scrubber section 152, where vapors from the reactor 158 are scrubbed to remove coke fines. The scrubbed product vapors 154 are sent to conventional fractionation and light ends recovery 420 (similar to the fractionation section of the delayed coker). The feed and recycle mixture is sprayed into the reactor 158 onto a fluidized bed of hot, fine coke particles. The mixture vaporizes and cracks, forming a coke film (.about 0.5 um) on the particle surfaces. Since the heat for the endothermic cracking reactions is supplied locally by these hot particles, this permits the cracking and coking reactions to be conducted at higher temperatures of about 510.degree. C.-565.degree. C. or (950.degree. F.-1050.degree. F.) and shorter contact times (15-30 seconds) versus delayed coking. As the coke film thickens, the particles gain weight and sink to the bottom of the fluidized bed. High-pressure steam 159 is injected via attriters and break up the larger coke particles to maintain an average coke particle size (100-600 um), suitable for fluidization. The heavier coke continues through the stripping section 160, where it is stripped by additional fluidizing media 161 (typically steam). The stripped coke (or cold coke) 162 is then circulated from the reactor 158 to the burner 164.

In the burner, roughly 15-25% of the coke is burned with air 166 in order to provide the hot coke nuclei to contact the feed in the reactor vessel. This coke burn also satisfies the process heat requirements without the need for an external fuel supply. The burned coke produces a low heating value (20-40 Btu/scf) flue gas 168, which is normally burned in a CO Boiler or furnace. Part of the unburned coke (or hot coke) 170 is recirculated back to the reactor to begin the process all over again. A carrier media 172, such as steam, is injected to transport the hot coke to the reactor vessel. In some systems, seed particles (e.g. ground product coke) must be added to these hot coke particles to maintain a particle size distribution that is suitable for fluidization. The remaining product coke 178 must be removed from the system to keep the solids inventory constant. It contains most of the feedstock metals, and part of the sulfur and nitrogen. Coke is withdrawn from the burner and fed into the quench elutriator 174 where product coke (larger coke particles) 178 are removed and cooled with water 176. A mixture 180 of steam, residual combustion gases, and entrained coke fines are recycled back to the burner.

An exemplary embodiment of the present invention may be readily integrated into the traditional, flexicoking and fluid coking systems, both new and existing. As shown in FIG. 6, this process flow diagram shows the traditional Flexicoking system of FIG. 5 with the addition of an example of the present invention in FIG. 1 and possible addition of FIG. 2. This simplified example shows the addition of a simplified reactor process with the addition of the catalytic additive system. Thus, an exemplary embodiment of the current invention integrates into the fluid coking process, a simple reaction vessel (310) that has sufficient controls to maintain desired reaction conditions, including (but not limited to) temperature, pressure and residence time. Note: Items 320 through 370 are not shown in FIG. 6 due to lack of space, but would be similar to those items in FIG. 1. The temperature is controlled by a feedback temperature controller (TC) (320) that controls the heat input of the process heater (330). The heater (330)

may be (1) a new separate process heater, (2) a separate coil in the existing coking process heater (e.g. with modifications), and/or (3) other heat exchange equipment, including potential cooling capabilities. This example of the added reactor process uses the outlet pressure of the feed pump (340) and back pressure controller (360) to control the pressure of the reaction vessel (310). The residence time in the reaction vessel is controlled by the design (e.g. space velocity) of the reaction vessel (310) for the desired flow rate of the coking process stream, and the flow rate of the process stream from the coking process. The flow rate of this reaction vessel (310) is controlled by the flow controller (FC) (370) that controls the flow of the feed pump (340). In this example, all or part of the fluid coking recycle (156) becomes the reactor process feed (380), which is pumped into the bottom of the primary reaction vessel (310) and the reaction products (390) exit the top of the primary reaction vessel (310) to become part of the vapor products stream (154) that goes to the fractionator (420). The solids (400) from the bottom of the reaction vessel (310) can be recirculated to the catalytic additive heated, mixing tank (210), if it has sufficient qualities. Otherwise, the solids (410) are further processed to recover and regenerate catalyst, sold as a by-product, or disposed.

As an additional option, the current invention contemplates the addition of the catalyst additive system of FIG. 2 to the added reactor process, the coking process, or both. As shown in FIG. 6, an exemplary embodiment of the current invention may add a heated, mixing tank (210) where components of the present invention's additive can be blended: catalyst(s) (220), seeding agent(s) (222), excess reactant(s) (224), carrier fluid(s) (226), and/or quenching agent(s) (228). The mixed additive (230) is then injected into the one or more points in the added reactor process via properly sized pump(s) (250) and piping, preferably with properly sized injection nozzle(s) (260). In this case, the pump is controlled by a flow meter (270) with a feedback control system relative to the specified set point for additive flow rate. In FIG. 6, the catalytic additive is injected into the reaction vessel (310) of the added reactor process. This same catalytic additive or a different catalytic additive could also be added to other points in the added reactor process and/or one or more points in the fluid coking process. Said one or more points in the fluid coking process would include (but should not be limited to) coking process feed blend 150, coking process reactor vessel (e.g. coking Vessel) 158, coking process burner 164, coking process recycle 156, coking process scrubber system 152, scrubbed product vapors 154, or any combination thereof. Also, the catalytic additive may be added to a coking vessel at or above where the feed enters said coking vessel. In addition, the catalytic additive may be injected into a coker feed line, a coker vapor line, a coker fractionator, a coker feed pump, a coker heater, or any combination thereof.

B. Process Control of the Known Art

In traditional fluid coking, the optimal operating conditions have evolved through the years, based on much experience and a better understanding of the process. Operating conditions have normally been set to maximize (or increase) the efficiency of feedstock conversion to cracked liquid products, including light and heavy coker gas oils. The quality of the byproduct petroleum coke is a relatively minor concern.

As with delayed coking, the target operating conditions in a traditional fluid coker depend on the composition of the coker feedstocks, other refinery operations, and the particular coker's design. The desired coker products also depend greatly on the product specifications required by other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular coker design, and determine appropriate operating conditions for a particular coker feedstock blend and particular product specifications for the downstream processing requirements. The series of pilot plant studies are typically designed to produce empirical data for operating conditions with variations in feedstock blends and liquid product specification requirements. Consequently, the fluid coker designs and target operating conditions vary significantly among refineries.

In normal fluid coker operations, various operational variables are monitored and controlled to achieve the desired fluid coker operation. The primary operational variables that affect coke product quality in the fluid coker are the reactor temperature, reactor residence time, and reactor pressure. The reactor temperature is controlled by regulating (1) the temperature and quantity of coke recirculated from the burner to the reactor and (2) the feed temperature, to a limited extent. The temperature of the recirculated coke fines is controlled by the burner temperature. In turn, the burner temperature is controlled by the air rate to the burner. The reactor residence time (i.e. for cracking and coking reactions) is essentially the holdup time of fluidized coke particles in the reactor. Thus, the reactor residence time is controlled by regulating the flow and levels of fluidized coke particles in the reactor and burner. The reactor pressure normally floats on the gas compressor suction with commensurate pressure drop of the intermediate components. The burner pressure is set by the unit pressure balance required for proper coke circulation. It is normally controlled at a fixed differential pressure relative to the reactor. The following target control ranges are normally maintained in the fluid coker for these primary operating variables:

1. Reactor temperatures in the range of about 950.degree. F. to about 1050.degree. F.,
2. Reactor residence time in the range of 15-30 seconds,
3. Reactor pressure in the range of about 0 psig to 100 psig: typically 0-5 psig,
4. Burner Temperature: typically 100-200.degree. F. above the reactor temperature, These traditional operating variables have primarily been used to control the quality of the cracked liquids and various yields of products, but not the respective quality of the byproduct petroleum coke.

C. Process Control of the Present Invention

There are various ways the present invention may improve existing or new flexicoking and fluid coking processes in crude oil refineries and upgrading systems for synthetic crudes. These novel improvements include, but should not be limited to, (1) reducing coke production, (2) reducing gas production by quenching product vapors in a manner that reduce 'vapor overcracking,' (3) increasing cracked liquids, (4) improving coker gas oil quality, (5) improving coke quality, (6) debottlenecking the heater, and (7) reducing recycle and vapor loading of fractionator.

In all the examples for flexicoking and fluid coking processes, an exemplary embodiment of the present invention provides the opportunity to develop catalytic additive(s) to address the specific needs of the particular refinery. That is, the catalytic additive(s) may be specifically designed to improve the yield distribution to the products that are most valuable to that refinery's process scheme and crude slate opportunities. This approach may simply involve catalytic cracking to produce greater yields of cracked liquids or may involve more sophisticated catalytic additive to be selective in what types of cracked liquids predominate. Similarly, an additional catalytic additive could be added to produce more of the desired products at that particular facility (e.g. propylene for local plastics plant). In this approach, the process optimization model in each refinery could be used as an effective tool in determining what catalytic additives would be preferable and worth pursuing (e.g. cost effectiveness and return on investment).

In many flexicoking and fluid coking applications of the present invention, an exemplary embodiment of the present invention may achieve one or more of the following: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (10) reduced catalyst make-up and emissions in downstream cracking units.

Example 3

As shown in FIG. 6, an exemplary embodiment of the current invention, adds a reactor process to the fluid coking process at a point where part or all of condensed recycle becomes the feed to the added reactor process. This exemplary embodiment could be advantageous in various refinery applications, including (but not limited to) (1) a coking process with excessive recycle (e.g. limiting coker & refinery throughput), (2) a coking process with excessive heavy gas oil endpoint (e.g. >1050 Degrees Fahrenheit), and/or (3) a coking process wherein the recycle contains excessive heavy aromatics (e.g. Polycyclic Aromatic Hydrocarbons (PAHs), asphaltenes, and/or asphaltene derivatives). In many of these cases, a reactor process added to the coking process designed to crack or coke these recycle materials may be very beneficial.

As noted in the invention summary and the general exemplary embodiment, an optional catalytic additive (i.e. vs. traditional catalyst alternatives) may be used in the reactor process added to the coking process. In addition, an optional catalytic additive can be added to the coking process, as described in U.S. Patent Application No. 61/026,028. In this exemplary embodiment, a catalytic additive is used in both the fluid coking process and the reactor process added to the fluid coking process. In this example, injection of a properly designed catalytic additive into the coking vessel would provide a fluidized cracking catalyst that would catalytically increase cracking of the coker feed and reduce the amount of coke production. With additional injection of a catalytic additive (primarily quenching agent) at the inlet to the scrubber would quench the vapor overcracking reaction and reduce gas production In this manner, a catalyst additive is injected in the coking process (e.g. via coking vessel) to crack coker feed materials that would otherwise form coke, and reduce the production of coke and produce more valuable cracked liquids. However, feed materials of the coking process that would otherwise form coke may tend to increase 'heavy tail' components of the heavy coker gas oil, thus increasing heavy gas oil end point, unless recycle is increased. In some of these cases, the reactor process may be added to (1) avoid limiting coker throughput by increasing recycle in a heater limited coker or (2) suffer lower conversion in downstream cracking units.

In this exemplary embodiment, the reactor process is added to a fluid coking process to maintain or improve coker gas oil quality (e.g. endpoint) and maintain or increase coker throughput by catalytically cracking condensed recycle materials, particularly heavy aromatic compounds (e.g. PAHs). As such, the reactor process is preferably added to the coking process at a point near the coking vessel 158. Conceivably, this reactor process could be added outside the coker boundary limits (e.g. in another process unit area), but placement as close to the coking process avoids long runs of pumping this difficult material to a distant process unit. In this manner, the recycle condensed by the wash oil could be readily processed by the added reactor process. The wash oil may also dilute the recycle to make it more pumpable, more readily processed, and other feed blend considerations. Part or all of the recycle may be treated as feed to the added reactor process.

In this exemplary embodiment, the design of the reactor process system employs a catalytic additive and focuses on cracking of the recycle materials, particularly heavy aromatics. Maximizing conversion of these heavy aromatics to lighter liquid products would likely require a simplified hydroprocessing process with high hydrogen partial pressure, low feed temperatures, and relatively long residence time. This theory of maximizing conversion of heavy aromatics is used in this exemplary embodiment, but should not limit the current invention. As such, the physical design of this reactor process could include, but should not be limited to, (1) a high pressure, vertical reaction vessel, (2) injection of catalytic additive vertically downward at centerline of the reaction vessel, (3) hydrogen injected in close proximity to catalytic additive, (4) feed added countercurrent (in some cases cocurrent) to the catalyst additive, (5) top (or side) draw of products, and (6) bottom draw of solids in center of reaction vessel. The design and operating conditions of this reactor process should include, but should not be limited to (1) temperature of reaction vessel maintained at a temperature of 600 to 850 degrees Fahrenheit (preferably 700 to 800 degrees Fahrenheit), (2) pressure of reaction vessel maintained at 1200 to 5000 psig (preferably 1500 to 3500 psig, and (3) space velocity of 0.1 to 1.5. Higher levels of catalytic additive may be required in the reactor process, versus the quantity limitations of up to 15 weight percent of the feed of the reactor process. The quantity of catalyst additive used in this exemplary embodiment would be between 0.1 weight percent and 50 weight percent; preferably between 0.1 weight percent and 10 weight percent. With this added reactor process primarily designed for catalytic cracking of aromatics, feed materials with high aromatics content from other refinery processes or outside the refinery may be desirable, as well. These additional feed materials may include, but should not be limited to FCCU slurry oils, FCCU cycle oils, extract from aromatic extraction units, gas oils, bitumen, and other aromatic oils, It should be noted that this added reactor process can be readily designed to run fairly independently of the coking process, allowing separate shutdown and maintenance, if needed. Technical and economic optimization of the added reactor process can be performed by one skilled in the art to determine where this type of added reactor process may be feasible.

CONCLUSION, RAMIFICATIONS, AND SCOPE OF THE INVENTION

Thus the reader will see that an exemplary embodiment of the coking process modification of the invention provide a highly reliable means to catalytically change the quantity and quality of the products of said coking processes. This novel coking process modification may provide the following advantages over traditional coking processes and recent improvements: (1) Increased cracked liquids, (2) less coke production, (3) less gas production, (4) improved coker gas oil quality, (2) improved coke quality and market value, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, (10) reduced catalyst make-up and emissions in downstream cracking units, and/or (8) provide incremental catalytic cracking capacity for a crude oil refinery or upgrading system.

While my above description contains many specificities, these should not be construed as limitations on the scope of the invention, but rather as an exemplification of one preferred embodiment thereof. Many other variations are possible. For example, Example 1 in the description of exemplary embodiments for delayed coking technology could also be applied to a similar fractionator with an extra heavy gas oil cut in a flexicoking or fluid coking processes.

Accordingly, the scope of the invention may be determined not by the embodiment(s) illustrated, but by the appended claims and their legal equivalents.

What is claimed is:

1. A delayed coking system comprising:

a heater section adapted to heat a combined delayed coking system feed and recycle to temperatures exceeding 900 degrees Fahrenheit;

a coke drum section in association with said heater section, said coke drum section adapted to delay coking of heavy hydrocarbons and crack heavy hydrocarbons to light hydrocarbon vapors;

a fractionation section in association with said coke drum section, said fractionation system adapted to separate said vapors into useful products including a coker process stream; and a chemical reactor system adapted to control temperature, pressure, and flow rate in a manner adapted to facilitate further chemical reactions of the coker process stream and return a product stream to said fractionation section;

wherein said delayed coking system is adapted to facilitate additional chemical reactions that cause a favorable modification of a quantity, a yield characteristic, a quality, or a property of a resulting product.

2. The system of claim 1 wherein said reactor system is selected from the group consisting of riser cracking reactor, fluidized bed reactor, ebullated bed reactor, fixed bed reactor, bunker reactor, plug flow reactor, or other reactor systems.

3. The system of claim 1 wherein said modification is adapted to be caused by the introduction of an additive to said reactor system, said additive comprising catalyst(s), seeding agent(s), excess reactant(s), quenching agent(s), carrier fluid(s), or any combination thereof.

4. The system of claim 3 wherein said catalyst is an acid based catalyst that is adapted to provide propagation of carbon based free radicals that actively participate in a mechanism of a cracking reaction, a coking reaction, or any combination thereof.

5. The system of claim 3 wherein said catalyst is selected from the group consisting of alumina, silica, zeolite, calcium compounds, iron compounds, activated carbon, crushed pet coke, or any combination thereof.

6. The system of claim 3 wherein said catalyst is selected from the group consisting of new catalyst, FCCU equilibrium catalyst, spent catalyst, regenerated catalyst, pulverized catalyst, classified catalyst, impregnated catalysts, treated catalysts, or any combination thereof.

7. The system of claim 3 wherein said catalyst has particle size characteristics adapted to prevent entrainment in the product vapors, achieve fluidization in said process reactor, or any combination thereof.

8. The system of claim 3 wherein the catalyst has sufficient porosity and other characteristics adapted to catalyze reactions with a reactant in a liquid phase, a vapor phase, a semi-solid phase, a solid phase, or any combination thereof.

9. The system of claim 3 further comprising a mixing system in association with said reactor system, said mixing system adapted to blend components of said additive using a batch or continuous mixing process prior to introduction of said additive to said reactor system.

10. The system of claim 1 wherein said coker process stream is adapted to be selected from the group consisting of coker product vapors, coker recycle, coker fractionator bottoms, coker naphtha, light coker gas oil, heavy coker gas oil, extra heavy coker gas oil, partially condensed coker product vapors, or any combination thereof.

11. The system of claim 1 wherein said reactor system is adapted to provide sufficient process conditions to promote cracking reactions, coking reactions, pyrolysis reactions, hydrogenation reactions, hydrogenolysis reactions, hydrolysis reactions, addition reactions, dehydrogenation reactions, condensation reactions, polymerization reactions, aromatization reactions, oligomerization reactions, isomerization reactions, or any combination thereof.

12. The system of claim 1 wherein said reactor system is adapted to use hydrogen to enhance chemical reactions.

13. The system of claim 1 wherein said reactor system is adapted to maintain an operating temperature, operating pressure, and space velocity for desired reactions.

14. The system of claim 13 wherein said operating temperature of the reactor system is adapted to be maintained by a fired heater of said coking system, a new fired heater, removal of insulation on process equipment of said coking system, a heat exchanger adapted to withdraw excess heat, other heat exchange equipment, or any combination thereof.

15. The system of claim 13 wherein said operating pressure is adapted to be maintained by a pressure of said coking system, a pressure of a compressed fluid to said reactor system, a pressure created by catalytic reactions, a pressure from an increase in volume of said process stream, or any combination thereof.

16. The system of claim 1 wherein said modification is adapted to caused by catalytic cracking, catalytic coking, thermal cracking, thermal coking, or any combination thereof.

17. The system of claim 1 wherein said modification is adapted to be used to reduce recycle in the coking system, reduce heavy components in coker gas oils, or any combination thereof.

18. The system of claim 1 wherein said reactor system is adapted to add a process stream external to said coking system to enhance chemical reactions or provide excess reactants in chemical reactions.

19. The system of claim 18 wherein said process stream is adapted to be selected from a group consisting of hydrogen, gas oils, FCCU slurry oils, FCCU cycle oils, extract from aromatic extraction units, coker feed, bitumen, other aromatic oils, coke, activated carbon, coal, carbon black, or any combination thereof.

* * * * *